US012757957B2

(12) United States Patent
Qian

(10) Patent No.: US 12,757,957 B2
(45) Date of Patent: Oct. 13, 2026

(54) SYSTEM FOR MANUFACTURING APPAREL

(71) Applicant: Hangzhou Taromed Medical Equipment Technology Co., Ltd., Hangzhou (CN)

(72) Inventor: Hao Qian, Hangzhou (CN)

(73) Assignee: Hangzhou Taromed Medical Equipment Technology Co., Ltd., Hangzhou (CN)

( * ) Notice: Subject to any disclaimer, the term of this patent is extended or adjusted under 35 U.S.C. 154(b) by 108 days.

(21) Appl. No.: 18/838,556

(22) PCT Filed: Feb. 14, 2022

(86) PCT No.: PCT/CN2022/076183
§ 371 (c)(1),
(2) Date: Aug. 14, 2024

(87) PCT Pub. No.: WO2023/151074
PCT Pub. Date: Aug. 17, 2023

(65) Prior Publication Data
US 2025/0151829 A1 May 15, 2025

(51) Int. Cl.
*A41H 42/00* (2006.01)

(52) U.S. Cl.
CPC ..... *A41H 42/00* (2013.01)

(58) Field of Classification Search
CPC ..... A41H 42/00
(Continued)

(56) References Cited

U.S. PATENT DOCUMENTS 6,557,479 B2 * 5/2003 Alberts ..... D05B 33/00 112/475.09
2002/0002938 A1 1/2002 Alberts et al.

FOREIGN PATENT DOCUMENTS

CN 104872915 A 9/2015
CN 109567293 A 4/2019
(Continued)

OTHER PUBLICATIONS

International Search Report issued in International Application No. PCT/CN2022/076183 dated Nov. 10, 2022 (5 pages).
(Continued)

*Primary Examiner* — James D Sells
(74) *Attorney, Agent, or Firm* — Osha Bergman Watanabe & Burton LLP

(57) ABSTRACT

A system for manufacturing apparel is disclosed. The apparel includes a two-layered collar, a collar lace, a belt, multiple sleeves, a front body cloth, a left rare body cloth, and a right rare body cloth. The system includes: a cloth feeder (1); a collar welding device (2); a collar lace welding device (3); a belt welding device (4); a collar cutting device (5); a sleeve welding device (6); a supplementary sleeve welding device (7); a body welding device (8); a shoulder welding device (9); and two sleeve makers (14). The cloth feeder (1), the collar welding device (2), the collar lace welding device (3), the belt welding device (4), the collar cutting device (5), the sleeve welding device (6), the supplementary sleeve welding device (7), the body welding device (8), the shoulder welding device (9) are disposed along an assembly direction. The sleeve makers (14) are adjacent to the sleeve welding device (6) and symmetrically disposed about the direction.

23 Claims, 32 Drawing Sheets

(58) Field of Classification Search
USPC ..... 156/556
See application file for complete search history.

(56) References Cited

FOREIGN PATENT DOCUMENTS

| | | | |
|---|---|---|---|
| CN | 110801070 | A | 2/2020 |
| CN | 111067162 | A | 4/2020 |
| CN | 112107068 | A | 12/2020 |
| CN | 113519924 | A | 10/2021 |
| CN | 215603446 | U | 1/2022 |

OTHER PUBLICATIONS

Written Opinion issued in International Application No. PCT/CN2022/076183 dated Nov. 10, 2022 (4 pages).

* cited by examiner

Before processing After processing

SYSTEM FOR MANUFACTURING APPAREL

BACKGROUND

This disclosure relates to techniques for manufacturing apparel, such as protective gowns for medical uses. The cloth used in the apparel could be very thin and light and the manufacturing process could be complex. In addition, the waste generated in the process for mass production could be significant to the cost and cannot be ignored.

SUMMARY

The disclosure is directed to a system for manufacturing apparel, wherein the apparel comprises a two-layered collar, a collar lace, a belt, a plurality of sleeves, a front body cloth, a left rear body cloth, and a right rear body cloth. The system includes: a cloth feeder; a collar welding device; a collar lace welding device; a belt welding device; a collar cutting device; a sleeve welding device; a supplementary sleeve welding device; a body welding device; a shoulder welding device; a cloth separator; a cloth folder; and a pair of sleeve makers that make the sleeves. The cloth feeder, the collar welding device, the collar lace welding device, the belt welding device, the collar cutting device, the sleeve welding device, the supplementary sleeve welding device, the body welding device, the shoulder welding device, the cloth separator, and the cloth folder are disposed in order along a direction from a first end of the system to the second end of the system. The pair of sleeve makers are disposed adjacent to the sleeve welding device. The pair of sleeve makers are symmetrically disposed about the direction.

Other aspects and advantages of the invention will be apparent from the following description and the appended claims.

DETAILED DESCRIPTION

Figure 1:
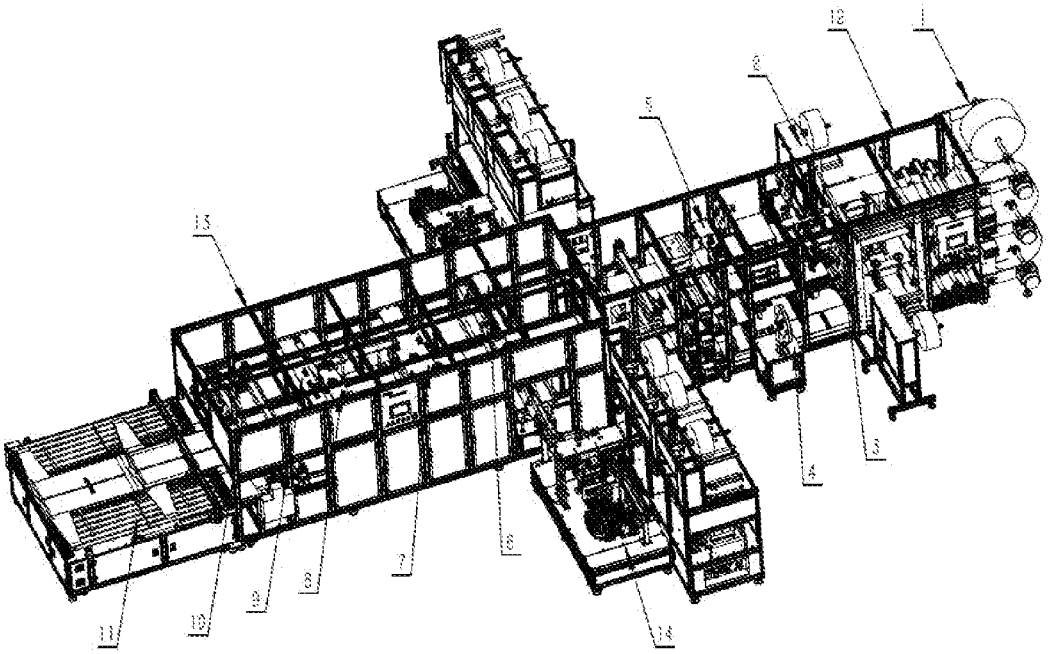
FIG. 1 shows a schematic block diagram of a system for manufacturing apparel according to one or more embodiments.

Specific embodiments of the invention will now be described in detail with reference to the accompanying figures. Like elements in the various figures are denoted by like reference numerals for consistency. Like elements may not be labeled in all figures for the sake of simplicity.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers does not imply or create a particular ordering of the elements or limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Figure 65:
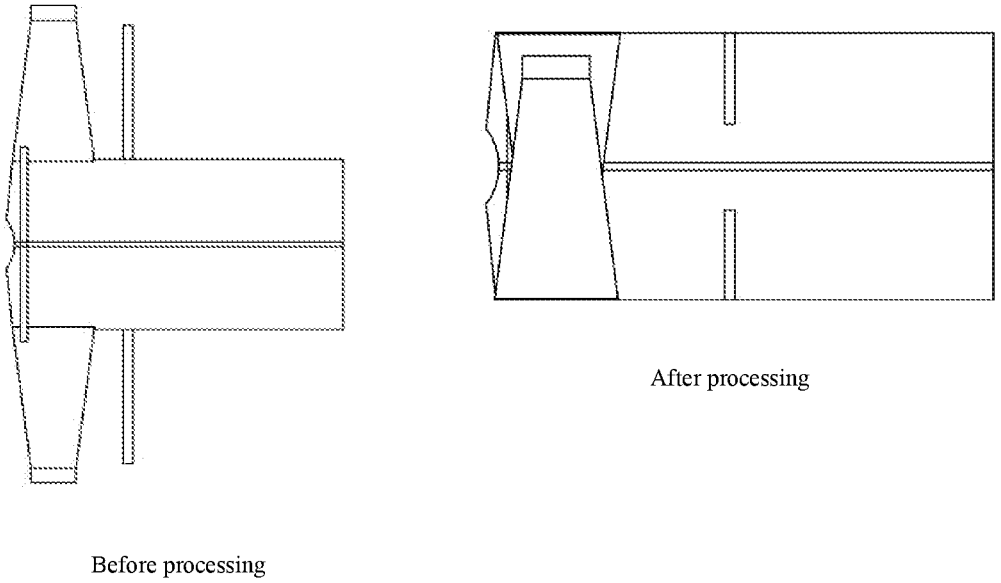
FIG. 65 shows ready-made clothing before and after being folded.

In the following description of FIGS. 1-65, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a horizontal beam" includes reference to one or more of such beams.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that, one or more of the steps shown in the flowcharts may be omitted, repeated, and/or performed in a different order than the order shown. Accordingly, the scope of the invention should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

FIG. 1 shows a schematic block diagram of a system for manufacturing apparel according to one or more embodiments.

As shown in FIG. 1, the system for manufacturing apparel according to one or more embodiments includes a cloth feeder 1, a collar welding device 2, a collar lace welding device 3, a belt welding device 4, a collar cutting device 5, a sleeve welding device 6, a supplementary sleeve welding device 7, a body welding device 8, a shoulder welding device 9, a cloth separator 10, a cloth folder 11, a first rack 12, a second rack 13 and sleeve makers 14.

Figure 2:
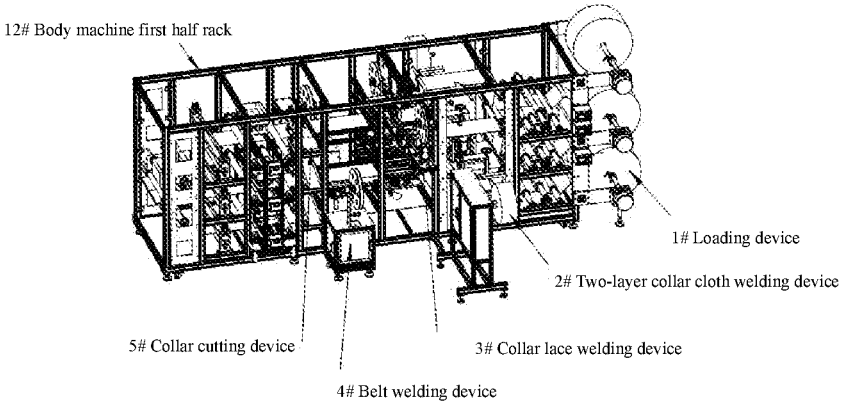
FIG. 2 shows a schematic diagram of installation of devices on a first rack.
Figure 3:
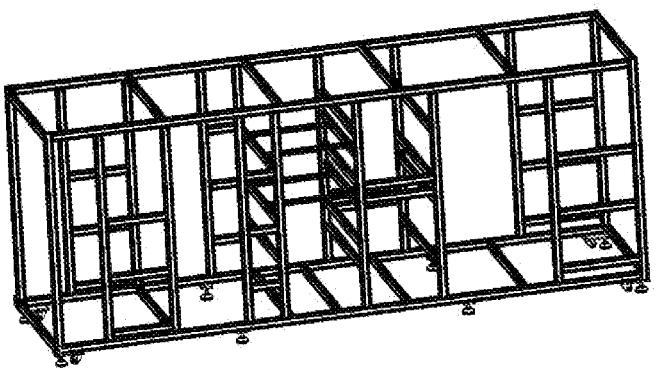
FIG. 3 shows a schematic diagram of the first rack.

FIG. 2 shows a schematic diagram of installation of devices on the first rack. FIG. 3 shows a schematic diagram of the first rack. As shown in FIGS. 1-3, the cloth feeder 1 is arranged on the right side of the first rack 12, the collar welding device 2 is arranged on the left side of the cloth feeder 1 and fixed at the bottom of the first rack 12, the collar lace welding device 3 is arranged on the left side of the collar welding device 2 and fixed at the middle position of the first rack 12, the belt welding device 4 is arranged on the left side of the collar lace welding device 3 and fixed at the bottom of the first rack 12, the collar cutting device 5 is arranged on the left side of the belt welding device 4, the collar cutting device 5 is divided into three layers, and the three layers of devices are respectively arranged at the upper position, the middle position and the lower position of the first rack 12 and are respectively used for cutting a left rear collar, a right rear collar and a front collar.

Figure 4:
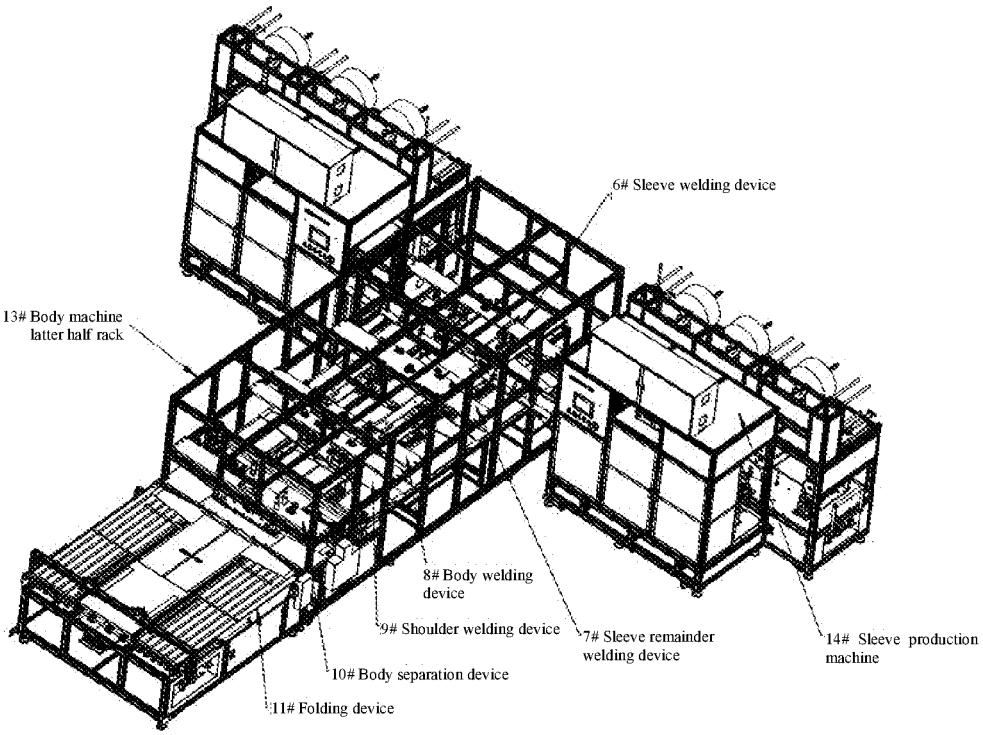
FIG. 4 shows a schematic diagram of installation of devices on a second rack.
Figure 5:
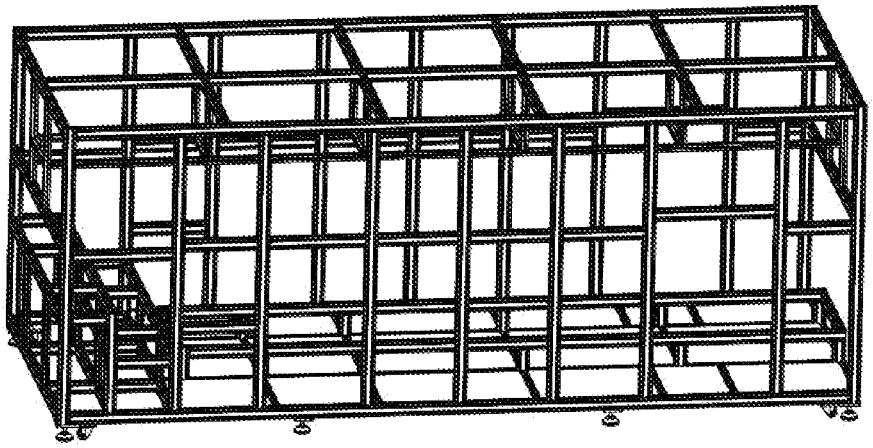
FIG. 5 shows a schematic diagram of the second rack.

FIG. 4 shows a schematic diagram of installation of devices on the second rack. FIG. 5 shows a schematic diagram of the second rack. As shown in FIG. 1, FIG. 4 and FIG. 5, the sleeve welding device 6 is fixed at the middle position of the right side of the second rack 13, the supplementary sleeve welding device 7 is arranged on the left side of the sleeve welding device 6 and fixed at the middle position of the second rack 13, the body welding device 8 is arranged on the left side of the supplementary sleeve welding device 7 and fixed at the middle position of the second rack 13, the shoulder welding device 9 is arranged on the left side of the body welding device 8 and fixed at the middle position of the second rack 13, the cloth separator 10 is arranged on the left side of the shoulder welding device 9 and fixed at the middle position of the second rack 13, the cloth folder 11 is arranged on the left side of the cloth separator 10 and connected to the bottom of the left side of the second rack 13, the sleeve makers 14 are symmetrically arranged on the two sides of the second rack 13, and the installation positions are at the sleeve welding device.

A rack on the left side of the first rack 12 and a rack on the right side of the second rack 13 are fixedly connected to each other by connecting parts such as bolts and the like.

When in work, cloth (such as a non-woven fabric) is loaded by the cloth feeder 1 firstly.

Figure 6:
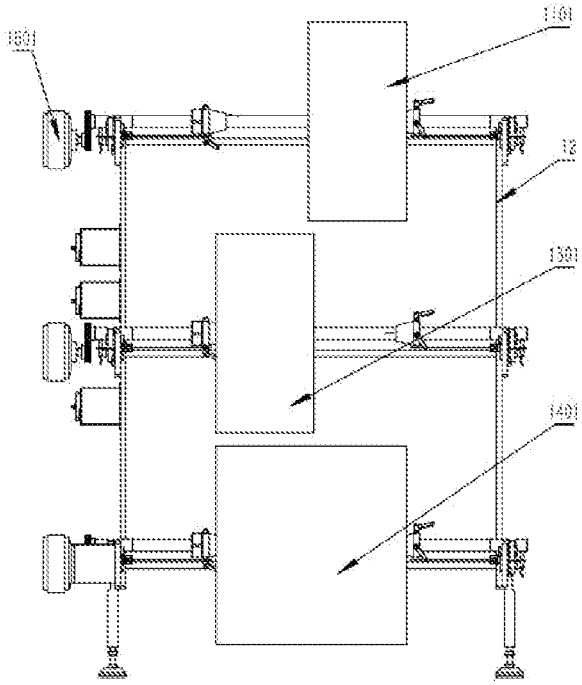
FIG. 6 shows a schematic diagram of a loading device according to one or more embodiments.

FIG. 6 shows a schematic diagram of the loading device according to one or more embodiments. As shown in FIG. 6, the cloth feeder 1 according to one or more embodiments includes: a right rear body cloth loading plate arranged on the first rack 12 ('rack 12' for short hereinafter) and used for loading right rear body cloth 1101; a left rear body cloth loading plate used for loading left rear body cloth 1301; a front body cloth loading plate used for loading front body cloth 1401; and a plurality of tension controllers 1501 respectively arranged at one end of the right rear body cloth loading plate, one end of the left rear body cloth loading plate and one end of the front body cloth loading plate. The three plates are disposed one above another and are movable along the direction of assembly, i.e., the direction from a first end of the system to the second end of the system. Three layers of non-woven fabrics are loaded, the loading is controlled by the tension controllers that control the stretching forces on the fabrics, and the tension controllers 1501 are used for adjusting the loading speed of loading rolls when in loading of the loading rolls. The tension controllers 1501 can be automatic stretch the controllers.

According to one or more embodiments, in the following three types of cloth: front body cloth, right rear body cloth and left rear body cloth, collar welding needs to be carried out on the front body cloth. Therefore, the front body cloth is delivered to the collar welding device 2.

Figure 7:
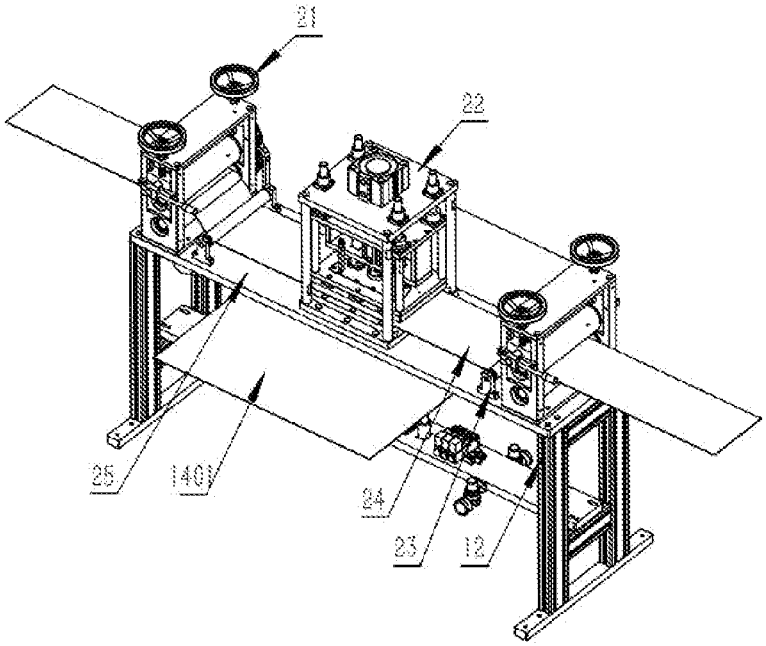
FIG. 7 shows a structural schematic diagram of a collar welding device according to one or more embodiments.
Figure 8:
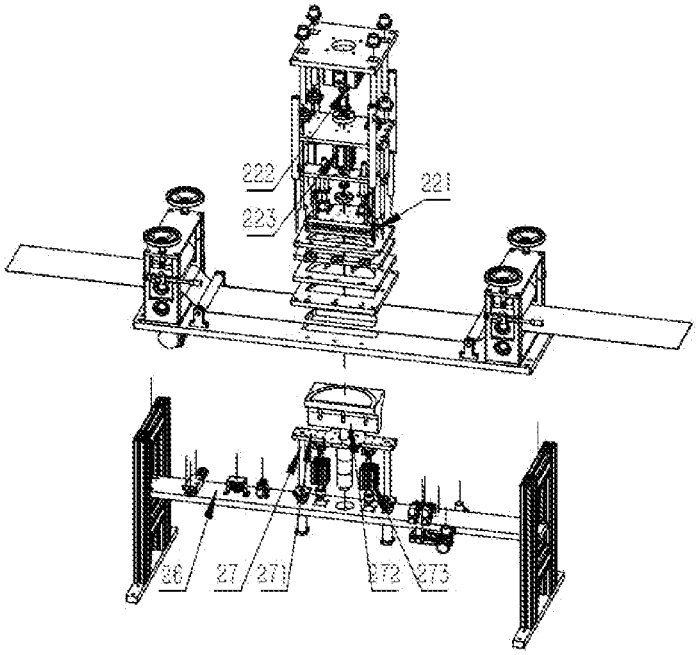
FIG. 8 shows an explosive view of the collar welding device according to one or more embodiments.
Figure 9:
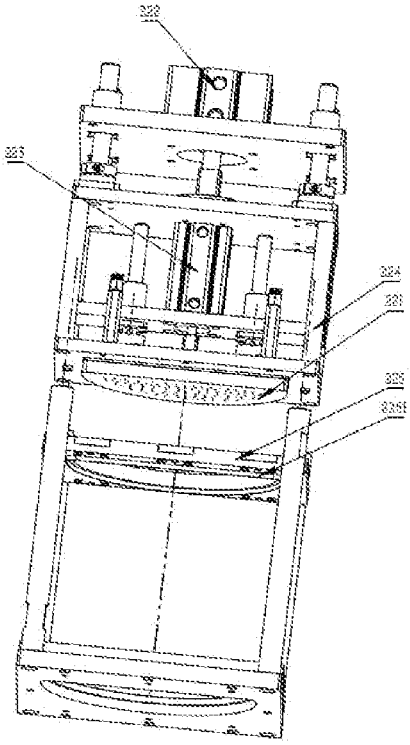
FIG. 9 shows an explosive view of an upper part welding die according to one or more embodiments.

FIG. 7 shows a structural schematic diagram of the collar welding device according to one or more embodiments. FIG. 8 shows an explosive view of the collar welding device according to one or more embodiments. As shown in FIG. 7 and FIG. 8, the collar welding device 2 includes a cloth tension mechanism 21, an upper part welding die 22, a guide roller 23, an upper fixing plate 25, a lower fixing plate 26 and a lower part welding die 27. The lower part welding die 27 includes a lower part welding die bracket 271, a lower part welding die head 272 and lower part welding die cylinders 273. FIG. 9 shows an explosive view of the upper part welding die according to one or more embodiments. As shown in FIG. 9, the upper part welding die according to one or more embodiments includes an upper part welding die rack 224, an upper part welding die head 221, a first cylinder 222, a second cylinder 223, a tailoring board 225 and a cutter 2251. The first cylinder 222 is arranged above the second cylinder 223. The first cylinder 222 can push the upper part welding die rack 224 to reciprocate up and down, so as to drive the cutter 2251 of the upper part welding die, connected to the bottom of the upper part welding die rack 224, to tailor cloth. The second cylinder 223 is arranged on the upper part welding die rack 224 and can move up and down along with the upper part welding die rack 224. The bottom of the second cylinder 223 is connected to the top of the upper part welding die head 221 and can drive the upper part welding die head 221 to move up and down, and the bottom of the upper part welding die rack 224 is connected to the top of the tailoring board 225 of the upper part welding die. The cutter 2251 is fixedly connected to the bottom of the tailoring board 225.

The tailoring board 225 and the cutter 2251 of the upper part welding die are hollow, the upper part welding die head 221 can move up and down at the hollow position of the cutter 2251, and the upper part welding die head 221 moves downwards to deliver a piece of cloth tailored down onto the lower part welding die 27 for carrying out ultrasonic fusion welding under the push of the second cylinder 223.

As shown in FIGS. 7-9, the bottom of the upper fixing plate 25 is connected to the top of the rack 12, the cloth tension mechanism 21 and the guide roller 23 are respectively arranged on the two sides of the upper fixing plate 25 symmetrically, the upper part welding die 22 is arranged at the middle position of the top of the upper fixing plate 25, the lower part welding die 27 is arranged at the middle position of the top of the lower fixing plate 26, the lower part welding die cylinders 273 are symmetrically arranged at the bottom of the lower part welding die bracket 271 of the welding mechanism, the lower part welding die head 272 is arranged at the middle position of the lower part welding die cylinders 273, and the lower part welding die cylinders 273 can push the lower part welding die head 272 in an up-and-down reciprocation manner.

Collar cloth 24 is conveyed to the cloth tension mechanism 21 by the loading rolls and a collecting roll (the collecting roll is provided with a motor as a power source.), the cloth tension mechanism 21 is used for stretching the cloth, and then the guide roller 23 is used for guiding the cloth, so that the cloth is adjusted to the height suitable for die welding. When the front body cloth 1401 passes the die welding position, the first cylinder 222 starts to work to drive the upper part welding die rack 224 connected to the bottom of the first cylinder 222 to move downwards, and at the same time, the tailoring board 225 of the upper part welding die, which is connected to the bottom of the upper part welding die rack 224, moves downwards; and the cutter 2251 of the upper part welding die is used for tailoring the collar cloth, then the second cylinder 223 drives the upper part welding die head 221 connected to the bottom of the second cylinder 223 to move downwards to push collar cloth tailored down to tightly cling to the upper part of the front body cloth 1401 of the clothing, and at the same time, the lower part welding die head 272 pushed upwards by the lower part welding die cylinders 273 and the upper part welding die head 221 are used for carrying out ultrasonic fusion welding on the cloth.

Figure 10:
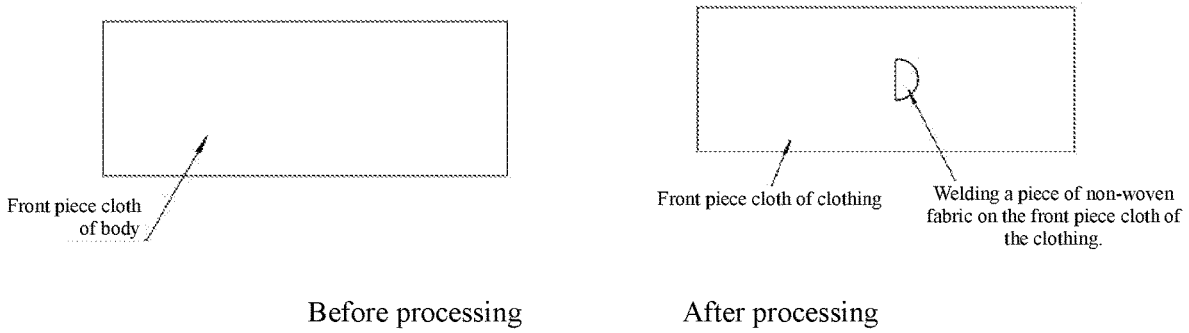
FIG. 10 shows schematic diagrams of front body cloth before and after being processed by the collar welding device according to one or more embodiments.

FIG. 10 shows schematic diagrams of the front body cloth before and after being processed by the collar welding device according to one or more embodiments.

According to the embodiment of the present invention, a collar is thickened by using two-layer cloth, the thickened two-layer cloth is not easy to deform, and the cloth is not enabled to curl inwards to scrape a neck, thereby improving the beauty and comfortability of wearing.

The front body cloth 1401 after being processed by the collar welding device is delivered to the belt welding device 4. The left part and the right part of the belt welding device 4 are symmetrical same structures, and only the structure of the single side of the belt welding device is described herein.

Figure 11:
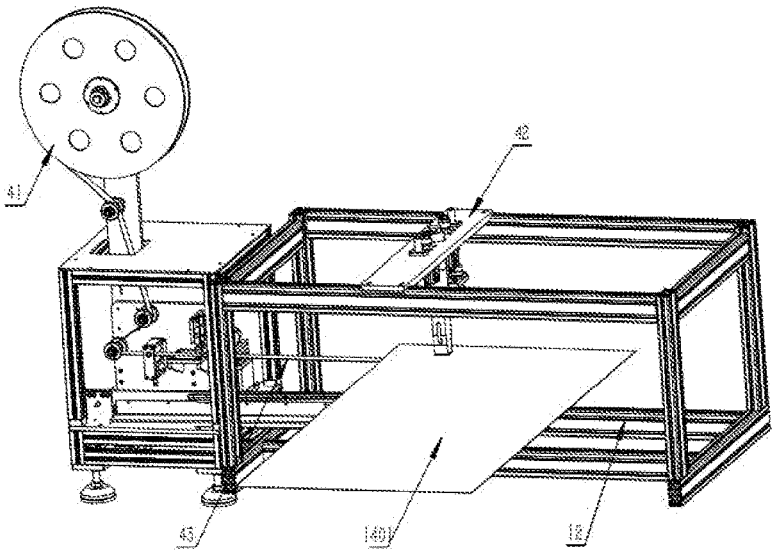
FIG. 11 shows a structural schematic diagram of a belt welding device according to one or more embodiments.
Figure 12:
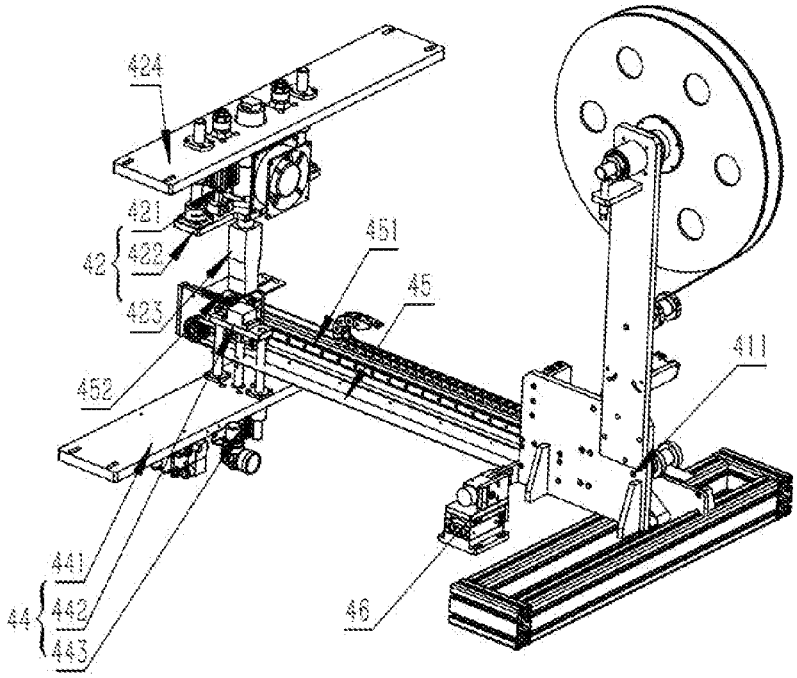
FIG. 12 shows a structural schematic diagram of the belt welding device after a rack is removed.

FIG. 11 shows a structural schematic diagram of the belt welding device according to one or more embodiments. FIG. 12 shows a structural schematic diagram of the belt welding device after the rack 12 is removed.

As shown in FIG. 11 and FIG. 12, the belt welding device according to one or more embodiments includes a belt feeding device 41, an upper part welding die 42, a lower part welding die 44, a belt clamping claw mobile mechanism 45 and a belt tailoring mechanism 46. The belt feeding device 41 includes a belt feeding device bracket 411 with a support function. The upper part welding die 42 includes upper part welding die cylinders 421, an upper part welding die head fixing plate 422, an upper part welding die head 423 and an upper part welding die fixing plate 424; the lower part welding die 44 includes a lower part welding die fixing plate 441, a lower part welding die head 442 and a lower part welding die cylinder 443; and the belt clamping claw mobile mechanism 45 includes a belt moving platform 451 and a belt clamping claw 452. The belt tailoring mechanism 46 is arranged between the belt feeding device 41 and the belt clamping claw 452 of the belt clamping claw mobile mechanism 45.

As shown in FIG. 11 and FIG. 12, the top of the rack 12 is connected to the upper part welding die 42, the left side of the rack 12 is connected to the belt feeding device 41, the lower part welding die 44 is connected to the bottom of the rack 12, and the belt clamping claw mobile mechanism 45 is connected to the belt feeding device bracket 411.

The upper part welding die fixing plate 424 is connected to the top of the rack 12. The tops of the upper part welding die cylinders 421 are symmetrically arranged at the bottom of the upper part welding die fixing plate 424, and the symmetry refers to that the number of the upper part welding die cylinders 421 is two and the two upper part welding die cylinders 421 are in the same structure; and the upper part welding die cylinders 421 are symmetrically arranged along the central axis of the upper part welding die head 423. The upper part welding die head 423 is arranged at the middle position of the upper part welding die head fixing plate 422, the bottoms of the upper part welding die cylinders 421 are connected to the upper part welding die head fixing plate 422 and can push the upper part welding die head fixing plate 422 to move up and down, so as to drive the upper part welding die head 423 arranged at the middle position of the upper part welding die head fixing plate 422 to move up and down. The lower part welding die cylinder 443 is arranged at the middle position of the lower part welding die fixing plate 441, the bottom of the lower part welding die head 442 is connected to the top of the lower part welding die cylinder 443, and the belt clamping claw 452 is connected to a sliding rail on the belt clamping claw belt moving platform 451. The clamping jaw is one of devices used for clamping belts and is driven by the cylinders, the cylinders push an upper plate and a lower plate of the clamping jaw to open and close to clamp the cloth.

Belt cloth 43 is fed by the belt feeding device 41, the belt clamping claw 452 is used for pulling the belt cloth 43 to move to the welding position by the belt clamping claw belt moving platform 451, the front body cloth 1401 of the clothing moves to the welding position at the same time, the upper part welding die cylinders 421 move downwards to push the upper part welding die head 423 to move downwards, the lower part welding die cylinder 443 moves upwards to push the lower part welding die head 442 to move upwards at the same time, ultrasonic fusion welding is carried out on the front body cloth 1401 of the clothing and the belt cloth 43 pulled to the position at the moment, then the belt tailoring mechanism 46 is used for tailoring the belt cloth 43, and the welding is ended. The belt tailoring mechanism 46 can be a scissor structure pushed by the cylinders.

According to one or more embodiments, the clamping jaw mobile platform is used. A cloth loading system may have no power source, the clamping jaw is used as power to pull the cloth to the welding position, and the tailoring mechanism is used for tailoring the cloth after the welding is ended; and after the tailoring (the belts of protective clothing are tailored down) is ended, a small section of cloth exposed is left at the tailoring position of the belt cloth, the clamping jaw can move to the position to grab the small section of cloth for next pulling, and the small section of cloth is pulled to the welding position.

According to an embodiment of the present invention, the number of the belts is two, one belt is located on the left side, and the other belt is located on the right side, and compared with one belt, the cloth is saved (as a section of cloth in the middle is lacked).

The belt welding device can be also arranged in front of a collar welding device. Namely, the belts are welded firstly, and then the collar cloth is welded.

According to another embodiment of the present invention, the belts can be also connected to left rear body cloth of a body and right rear body cloth of the body, one belt (e.g., a left belt piece) is welded on the left side, and the other belt (e.g., a right belt piece) is welded on the right side. The device for realizing welding can be seen in the above descriptions.

Figure 13:
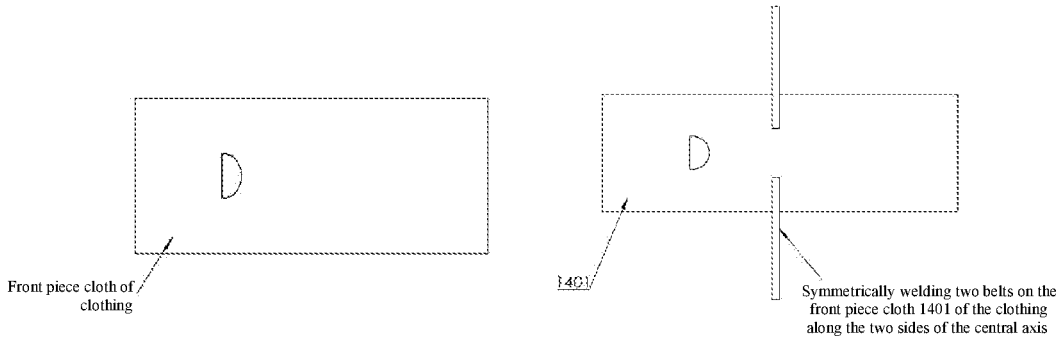
FIG. 13 shows schematic diagrams of front body cloth before and after being processed by the belt welding device according to one or more embodiments.

FIG. 13 shows schematic diagrams of the front body cloth before and after being processed by the belt welding device according to one or more embodiments.

Back to FIG. 1, the right rear body cloth 1101 of the clothing and the left rear body cloth 1301 of the clothing are delivered to the collar lace welding device 3. The left part and the right part of the collar lace welding device 3 are symmetrical same structures, and only the structure of the single side of the collar lace welding device is described herein.

Figure 14:
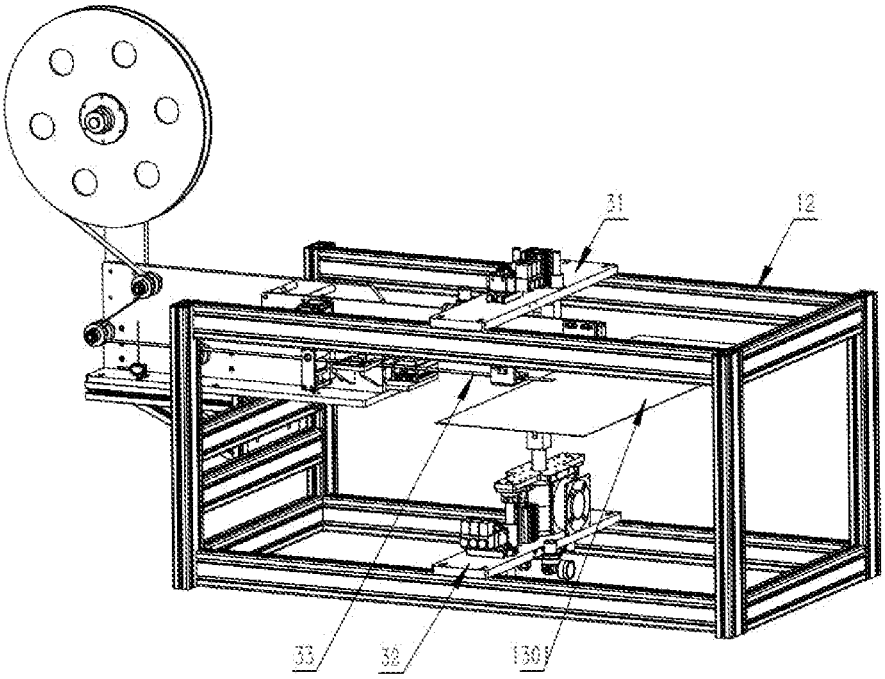
FIG. 14 shows a structural schematic diagram of a collar lace welding device according to one or more embodiments.
Figure 15:
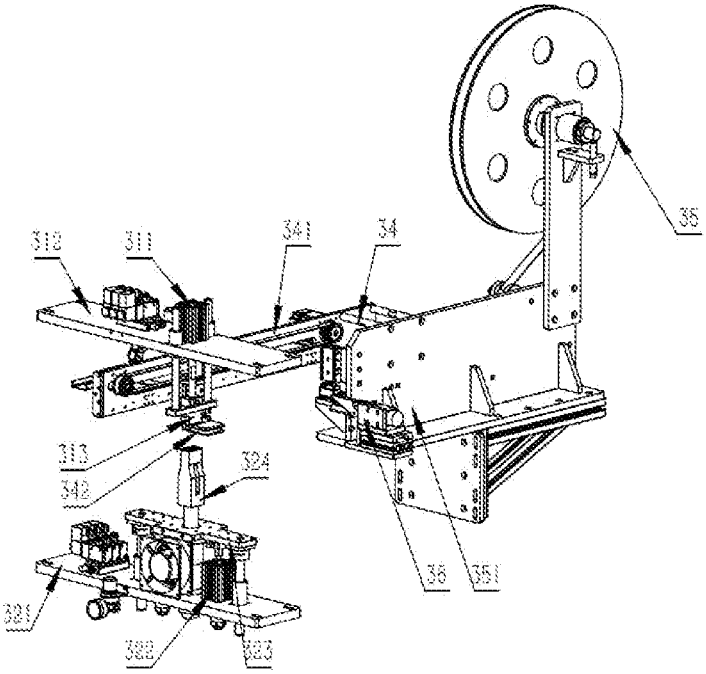
FIG. 15 shows a structural schematic diagram of the collar lace welding device after a rack is removed.

FIG. 14 shows a structural schematic diagram of the collar lace welding device according to one or more embodiments. FIG. 15 shows a structural schematic diagram of the collar lace welding device after the rack 12 is removed. As shown in FIG. 14 and FIG. 15, the collar lace welding device includes an upper part welding die 31, a lower part welding die 32, a collar lace feeding device 34, a collar lace loading device 35 and a collar lace tailoring device 36. The upper part welding die 31 includes an upper part welding die cylinder 311, an upper part welding die fixing plate 312 and an upper part welding die head 313. The lower part welding die 32 includes a lower part welding die fixing plate 321, lower part welding die cylinders 322, a lower part welding die head fixing plate 323 and a lower part welding die head 324. The collar lace feeding device 34 includes a collar lace clamping jaw mobile platform 341 and a collar lace clamping jaw 342. The collar lace loading device 35 includes a collar lace loading device bracket 351 with a support function. According to one embodiment, the collar lace loading device 35 may include one roll and several guide rollers, so as to realize the loading function.

One side of the rack 12 is connected to the collar lace loading device 35, the top of the rack 12 is connected to the upper part welding die 31, the bottom of the rack 12 is connected to the lower part welding die 32, the collar lace feeding device 34 is fixedly arranged on one side of the collar lace loading device bracket 351, the collar lace tailoring mechanism 36 is fixedly arranged on the collar lace loading device bracket 351.

The upper part welding die fixing plate 312 is connected to the rack 12, the upper part welding die cylinder 311 is arranged at the middle position of the upper part welding die fixing plate 312, the bottom of the upper part welding die cylinder 311 is connected to the top of the upper part welding die head 313, the lower part welding die cylinders 322 are symmetrically arranged on the two sides of the lower part welding die fixing plate 321 (the lower part welding die cylinders 322 are symmetrical along the central axis of the lower part welding die head 324, and the number of the cylinders is two.), the bottoms of the lower part welding die cylinders 322 are connected to the top of the lower part welding die fixing plate 321, the lower part welding die head 324 is arranged at the middle position of the lower part welding die head fixing plate 323, the collar lace clamping jaw 342 is arranged at the position of a guide rail of the collar lace clamping jaw mobile platform, and the collar lace tailoring device 36 is arranged between the collar lace clamping jaw 342 and the collar lace loading device 35.

Collar lace cloth 33 is loaded by the collar lace loading device, the collar lace clamping jaw 342 pulls the collar lace cloth 33 to the welding position, the left rear body cloth 1301 of the clothing is conveyed to the welding position at the same time, the upper part welding die cylinder 311 moves downwards to push the upper part welding die head 313 to move downwards, the lower part welding die cylinders 322 move upwards to push the lower part welding die head 324 to move upwards at the same time, ultrasonic fusion welding is carried out on the left rear body cloth 1301 of the clothing and the collar lace cloth 33 pulled to the position at the moment, then the collar lace tailoring device 36 is used for tailoring the collar lace cloth 33, and the welding is ended. In some embodiments, the collar lace includes a left collar lace piece and a right collar lace piece that are welded onto the left rear body cloth and the right rear body cloth, respectively.

Figure 16:
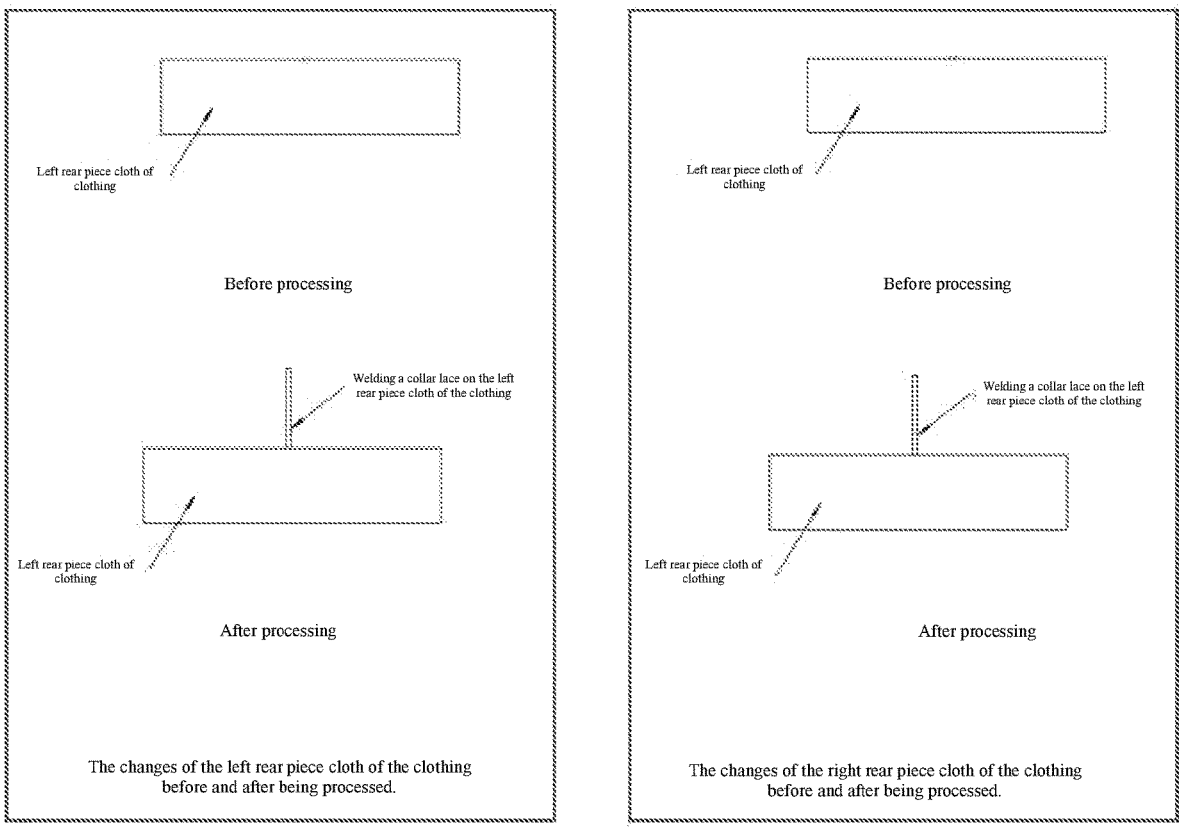
FIG. 16 shows schematic diagrams of right rear body cloth and left rear body cloth before and after being processed by the collar lace welding device according to one or more embodiments.

FIG. 16 shows schematic diagrams of the right rear body cloth and the left rear body cloth before and after being processed by the collar lace welding device according to one or more embodiments.

Front body cloth of the belts is added, the right rear body cloth and the left rear body cloth of a collar lace are added, and the front body cloth, the right rear body cloth and the left rear body cloth are delivered to the collar cutting device.

Figure 17:
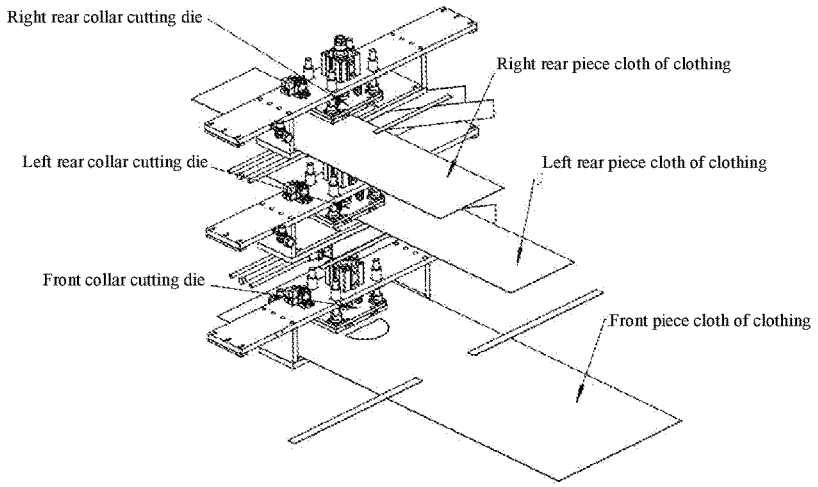
FIG. 17 shows a structural schematic diagram of work of a collar cutting device according to one or more embodiments.
Figure 18:
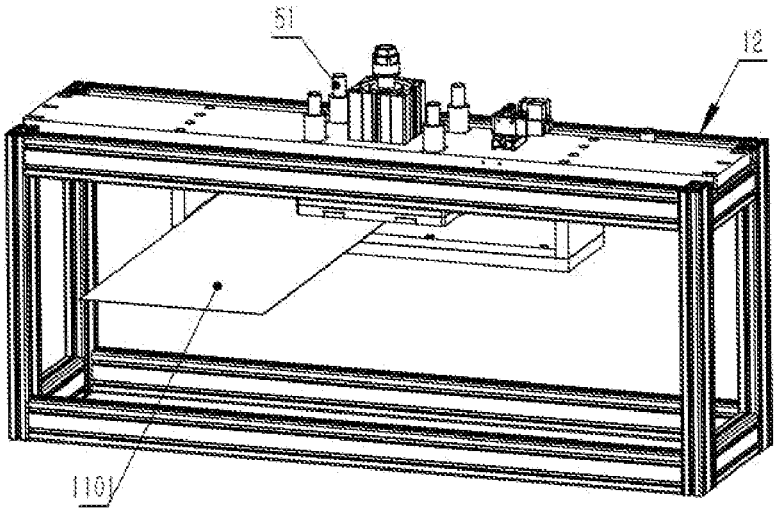
FIG. 18 shows a structural schematic diagram of a right rear piece collar cutting device according to one or more embodiments.

FIG. 17 shows a structural schematic diagram of work of the collar cutting device according to one or more embodiments. It can be seen from the figure that the collar cutting device includes a left rear piece collar cutting device, a right rear piece collar cutting device and a front piece collar cutting device. According to one embodiment, the left rear piece collar cutting device, the right rear piece collar cutting device and the front piece collar cutting device are in the same structure, and only the right rear piece collar cutting device is described herein. FIG. 18 shows a structural schematic diagram of the right rear piece collar cutting device according to one or more embodiments; and FIG. 19 shows a structural schematic diagram of the right rear piece collar cutting device after the rack 12 is removed.

Figure 19:
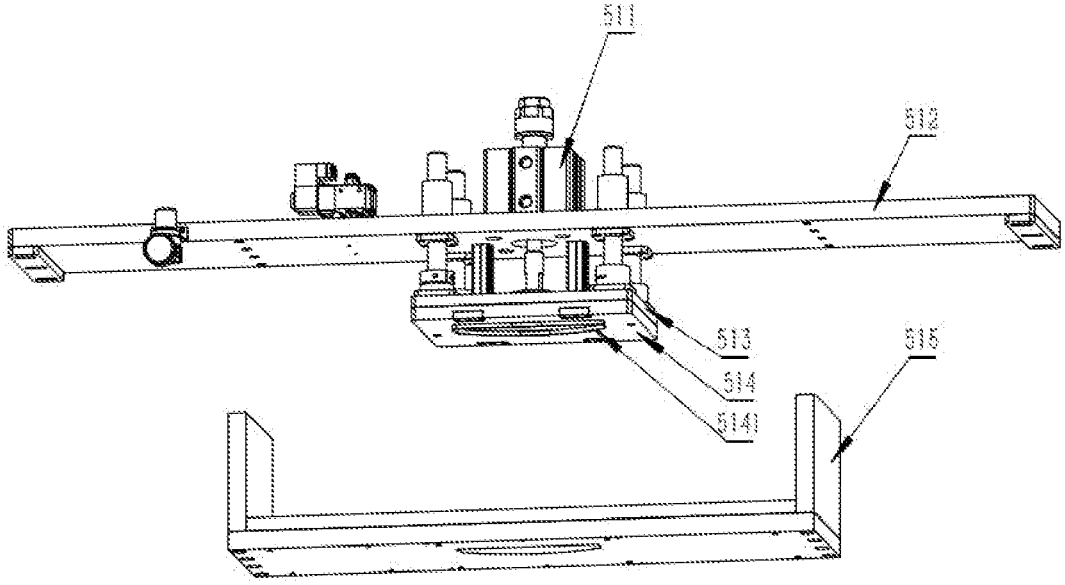
FIG. 19 shows a structural schematic diagram of the right rear piece collar cutting device after a rack is removed.

As shown in FIG. 18 and FIG. 19, the right rear piece collar cutting device 51 includes a cutting die cylinder 511, a cutting die fixing plate 512, a cutting die tailoring board push plate 513, a cutting die tailoring board 514, a cutting die cutter 5141 and a cutting die bottom baffle plate 515.

The top of the rack 12 is connected to the bottom of the cutting die fixing plate 512, the cutting die cylinder 511 is fixedly arranged at the middle position of the cutting die fixing plate 512, the bottom of the cutting die cylinder 511 is connected to the top of the cutting die tailoring board push plate 513, the bottom of the cutting die tailoring board push plate 513 is connected to the top of the cutting die tailoring board 514, the top of the cutting die cutter 5141 is connected to the bottom of the cutting die tailoring board 514, and the top of the cutting die bottom baffle plate 515 is connected to the bottom of the cutting die fixing plate 512.

After the right rear body cloth 1101 moves to the cutting position, the cutting die cylinder 511 moves downwards to push the cutting die tailoring board push plate 513 to move downwards, the cutting die tailoring board 514 connected to the cutting die tailoring board push plate 513 moves downwards to push the cutting die cutter 5141 connected to the cutting die tailoring board 514 to move downwards, and then the cutting die cutter 5141 is combined with the cutting die bottom baffle plate 515 and is used for cutting a cut in a collar shape on the right rear body cloth 1101 of the clothing.

According to one or more embodiments, the size of a cutter of a left rear collar cutting die is the same as that of a cutter of a right rear collar cutting die, and a cutter of a front collar cutting die is bigger than the cutter of the left rear collar cutting die and the cutter of the right rear collar cutting die. In addition, according to one or more embodiments, the front collar is cut at the two-layer cloth.

Figure 20:
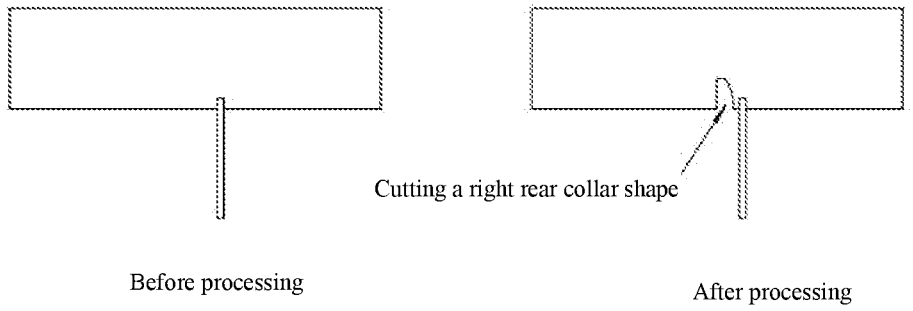
FIGS. 20-22 respectively show schematic diagrams of right rear body cloth, left rear body cloth and front body cloth before and after being processed by the collar cutting device.
Figure 21:
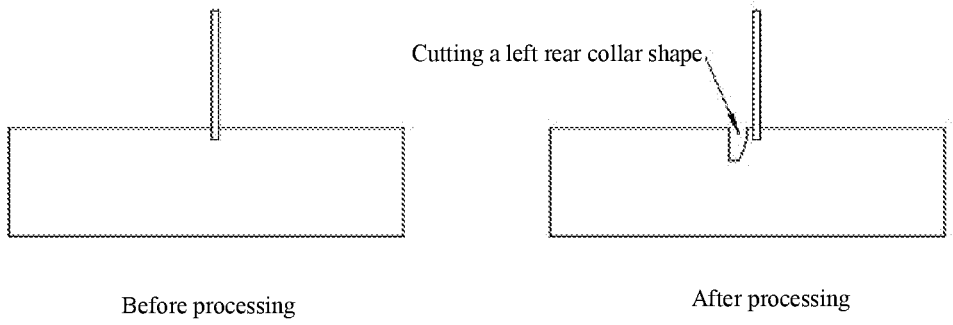
Figure 22:
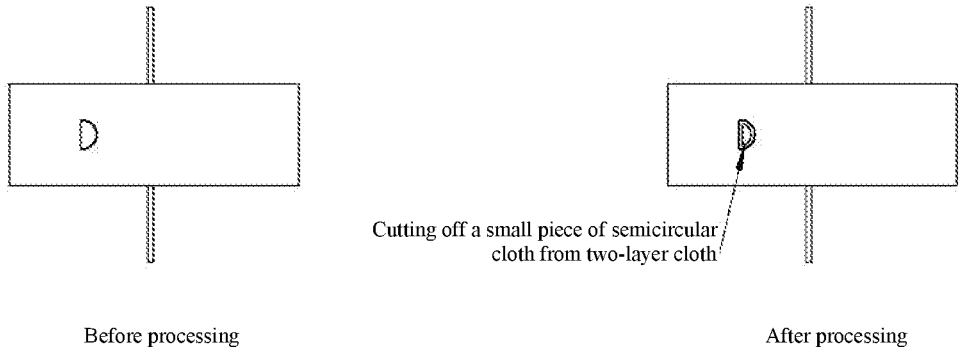

FIGS. 20-22 respectively show schematic diagrams of the right rear body cloth, the left rear body cloth and the front body cloth before and after being processed by the collar cutting device.

Figure 23:
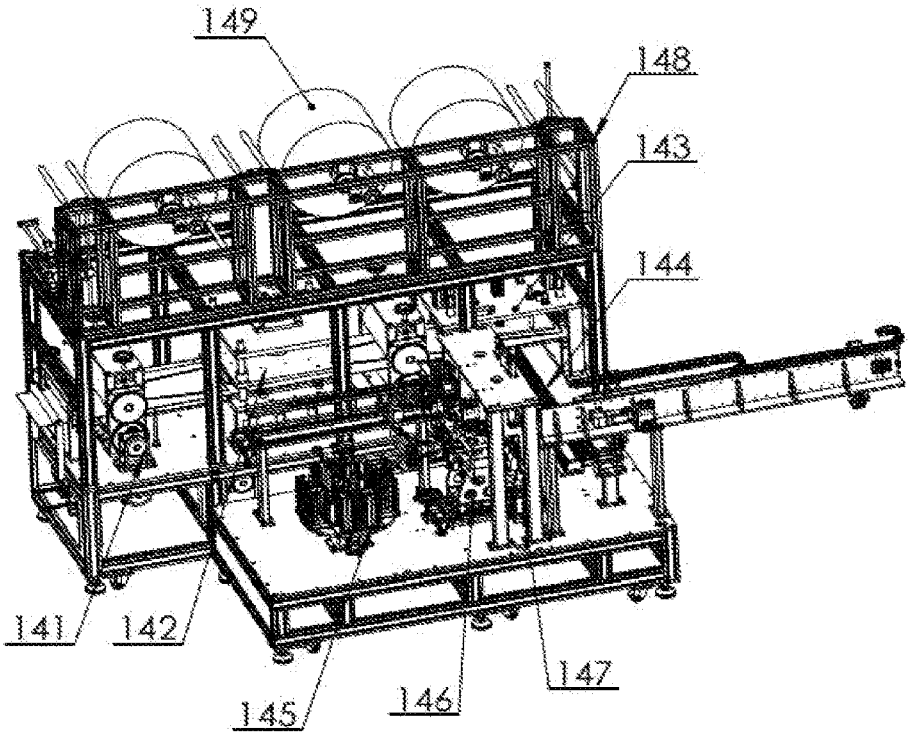
FIG. 23 shows a schematic diagram of a sleeve maker according to one or more embodiments.
Figure 24:
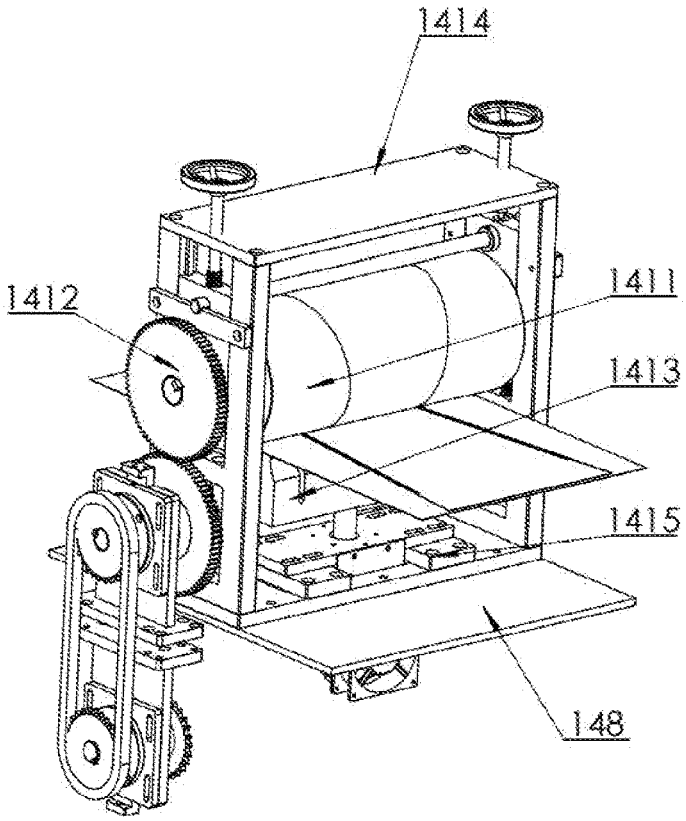
FIG. 24 shows a structural schematic diagram of a roll welding mechanism of the sleeve maker according to one embodiment.

The sleeve makers are used for producing sleeves at the same time with the above operations. FIG. 23 shows a schematic diagram of the sleeve maker according to one or more embodiments. As shown in FIG. 23, the sleeve maker includes a roll welding mechanism 141, a die cutting mechanism 142, a tailoring mechanism 143, a sleeve transferring mechanism 144, a sleeve head taking mechanism 145, a sleeve head mobile mechanism 146, a sleeve head welding mechanism 147, a sleeve maker rack 148 and a loading mechanism 149. FIG. 24 shows a structural schematic diagram of the roll welding mechanism of the sleeve maker according to one embodiment. As shown in FIG. 24, the roll welding mechanism 141 of the sleeve maker according to one embodiment includes a roll welding die 1411, a driving mechanism 1412, a welding die head 1413, a roll welding die rack 1414 and a welding die head fixing plate 1415.

The bottom of the roll welding die rack 1414 is arranged at the top of the sleeve maker rack 148, the roll welding die 1411 is arranged in the roll welding die rack 1414, the welding die head fixing plate 1415 is arranged at the bottom of the roll welding die rack 1414, and the welding die head 1413 is arranged at the middle position of the welding die head fixing plate 1415.

Sleeve cloth is loaded by the loading mechanism 149 and is collected into the two-layer cloth. According to one embodiment, the loading mechanism 149 includes three rolls, two rolls are used for loading, the two-layer cloth after being loaded enters a roll welding device and starts to be processed, waste cloth after tailoring of a tailoring device enters a collecting roll. A motor of the driving mechanism 1412 is used for driving the roll welding die 1411 to rotate, the roll welding die 1411 and the welding die head 1413 keep a compression state, when the cloth passes, the required sleeve shape is formed through roll welding, and the cloth is transferred forwards. When the two-layer cloth after being loaded by the loading device 149 passes the roll welding die 1411, the driving mechanism 1412 is used for driving the roll welding die 1411 to rotate, convex knurls are formed on the roll welding die 1411 and touch the welding die head 1413 at the bottom, and when the two-layer sleeve cloth passes, the ⅔ length of a total sleeve in the length direction is welded in the length direction of the two sides of the sleeve (the ⅔ length of the sleeve is welded here for the purpose that in the sleeve welding device, the sleeve is sucked up successfully by a sleeve suction clamping mechanism arm and is inserted into body cloth.). According to one embodiment, the driving mechanism 1412 is provided with a controller (such as a programmable logic controller (PLC)) and a servo motor. The PLC can be used for calculating the moving distance and the welding length of the cloth by adopting an encoder of the servo motor.

The ⅔ length of the sleeve is welded here, and the remaining ⅓ length (the connecting position of the sleeve and the body) of the sleeve in the length direction of the sleeve is welded (ultrasonic roll welding) in the device 7 for welding the remaining length of the sleeve of a body machine. The ⅔ length is only exemplary, and the length can be ⅗-¾. The length can be predetermined, so long as the remaining part can enable the sleeve suction clamping mechanical arm to successfully complete the work. Due to the setting, the butting of a round sleeve and the body can be avoided. The butting of the round sleeve and the body is very difficult, so that the butting is difficultly completed by a machine, or the machine is very complex. However, according to a method of the embodiment, a part of length is reserved and is not welded (one embodiment of jointing), so that the butting of the sleeve and the body can be realized by a simple structure.

Figure 25:
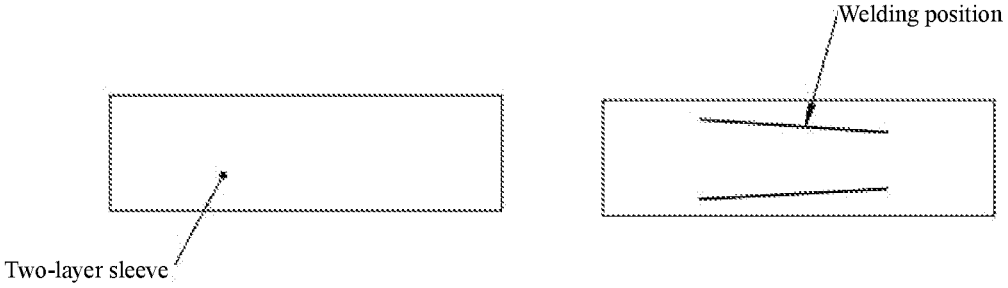
FIG. 25 shows states of two-layer sleeve cloth before and after being processed by the roll welding mechanism of the sleeve maker.

FIG. 25 shows states of the two-layer sleeve cloth before and after being processed by the roll welding mechanism of the sleeve maker.

Two welding lines extend along the length direction of the sleeve, and a predetermined angle is formed between each of the welding lines and the length direction (a horizontal line shown in the figure) of the sleeve.

Figure 26:
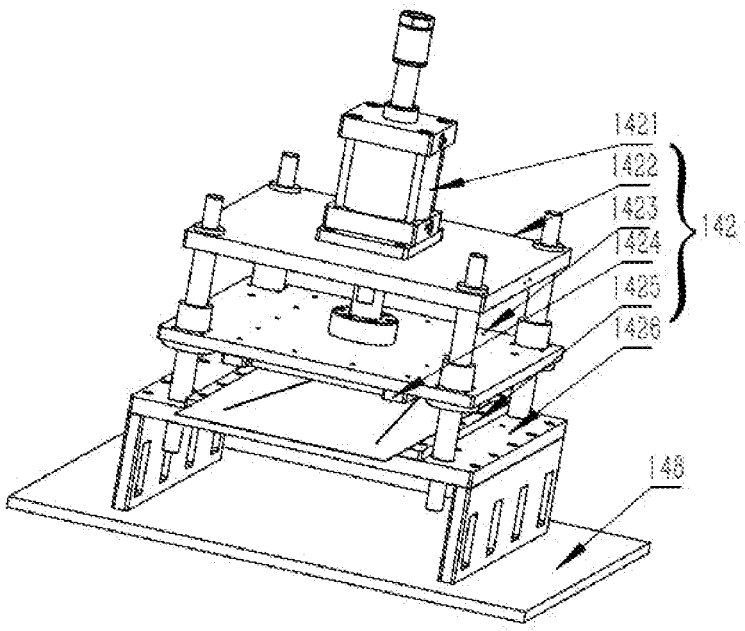
FIG. 26 shows a structural schematic diagram of a die cutting mechanism of the sleeve maker according to one or more embodiments.
Figure 27:
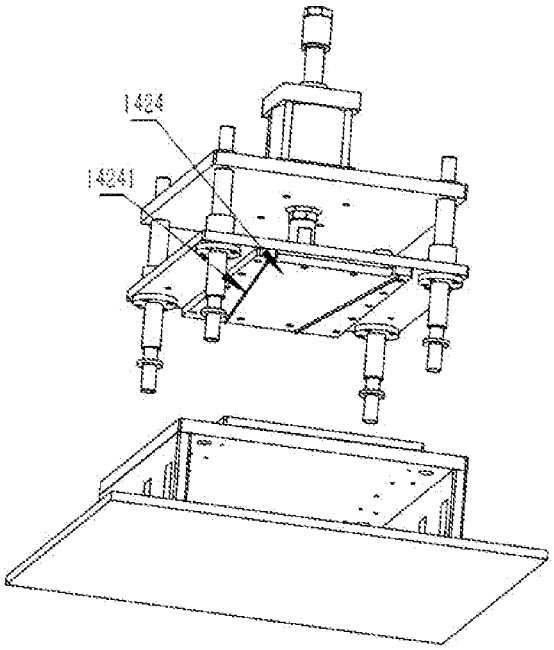
FIG. 27 shows a structural schematic explosive view of the die cutting mechanism of the sleeve maker according to one or more embodiments.

FIG. 26 shows a structural schematic diagram of the die cutting mechanism of the sleeve maker according to one or more embodiments. FIG. 27 shows a structural schematic explosive view of the die cutting mechanism of the sleeve maker according to one or more embodiments.

As shown in FIG. 26 and FIG. 27, the die cutting mechanism of the sleeve maker according to one or more embodiments includes a die cutting mechanism cylinder 1421, a die cutting mechanism cylinder fixing plate 1422, a die cutting die connecting plate 1423, a die cutting die 1424, a die cutting bottom plate 1425, a welding bottom plate connecting plate 1426 and a cutter 14241.

The die cutting mechanism cylinder 1421 is arranged at the middle position of the top of the die cutting mechanism cylinder fixing plate 1422, the bottom of the die cutting mechanism cylinder 1421 is connected to the top of the die cutting die connecting plate 1423, the top of the die cutting die 1424 is connected to the bottom of the die cutting die connecting plate 1423, the cutter 14241 is fixedly arranged on the die cutting die 1424, the bottom of the die cutting bottom plate 1425 is arranged at the top of the welding bottom plate connecting plate 1426, and the welding bottom plate connecting plate 1426 is connected to the rack 148 by plates on the two sides.

Figure 28:
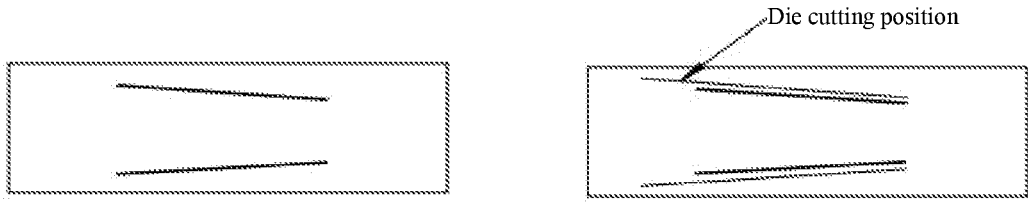
FIG. 28 shows states of two-layer sleeve cloth before and after being processed by the die cutting mechanism of the sleeve maker.

When the two-layer sleeve cloth after being processed through roll welding passes the die cutting mechanism, the die cutting mechanism cylinder 1421 moves downwards to drive the die cutting die connecting plate 1423 connected to the bottom of the die cutting mechanism cylinder 1421 to move downwards, the die cutting die connecting plate 1423 moves downwards to drive the die cutting die 1424 connected to the die cutting die connecting plate 1423 to move downwards, the cutter 14241 is fixedly connected to the bottom of the die cutting die 1424, and two cuts in the length direction of the sleeve are cut on the outer side of the welding position when the two-layer sleeve cloth passes. According to one or more embodiments, a pressing device may be set to press and tighten the two-layer sleeve cloth before cutting. The cutting may be performed by the cutter sliding and cutting in the length direction of the sleeve. In another embodiment, the cutting may be done by die cutting with a flat blade. FIG. 28 shows states of the two-layer sleeve cloth before and after being processed by the die cutting mechanism of the sleeve maker.

Figure 29:
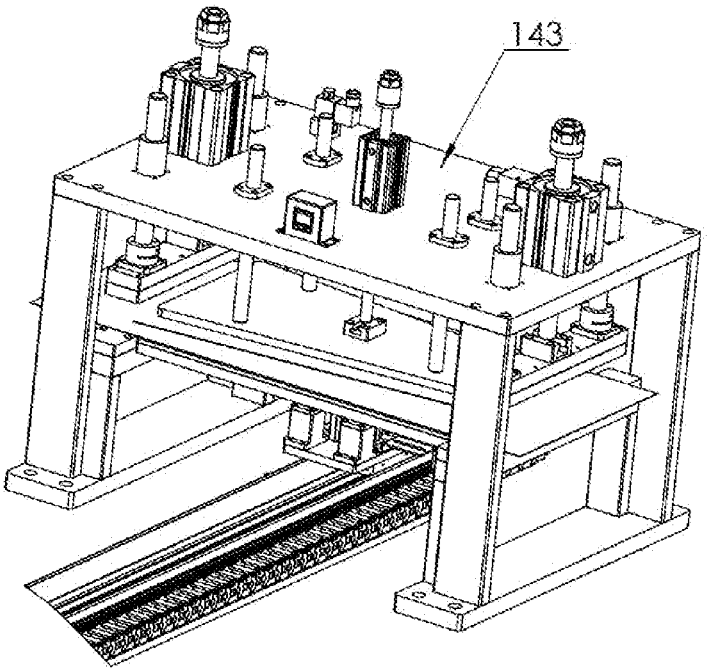
FIG. 29 shows a structural schematic diagram of a tailoring mechanism of the sleeve maker according to one or more embodiments.
Figure 30:
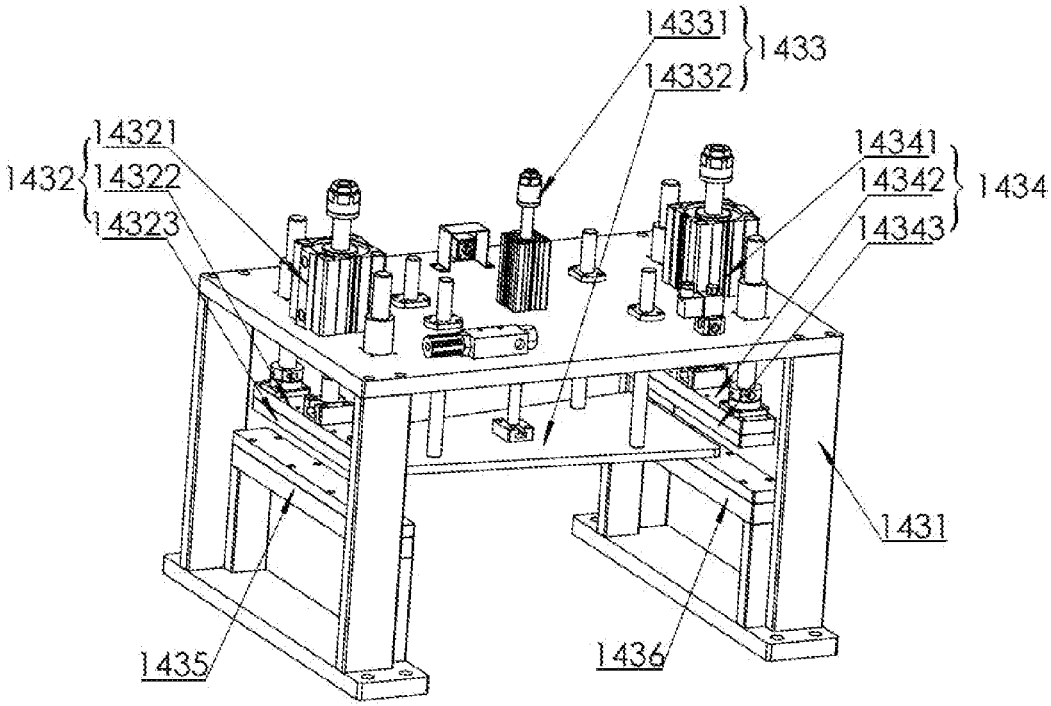
FIG. 30 shows a structural view of the tailoring mechanism of the sleeve maker according to one or more embodiments.
Figure 31:
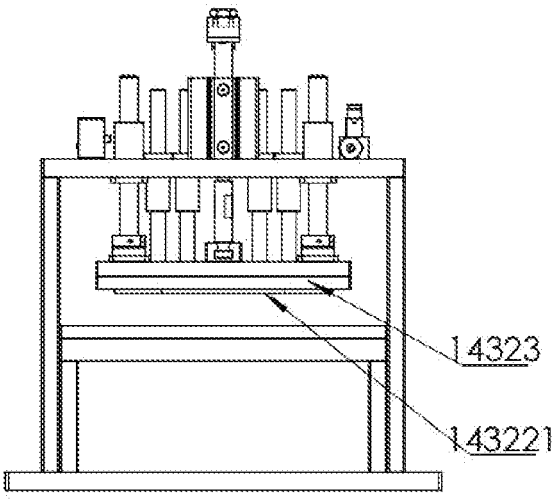
FIG. 31 shows a side view of the tailoring mechanism of the sleeve maker.

FIG. 29 shows a structural schematic diagram of the tailoring mechanism of the sleeve maker according to one or more embodiments. FIG. 30 shows a structural view of the tailoring mechanism of the sleeve maker according to one or more embodiments, wherein the sleeve cloth is removed. FIG. 31 shows a side view of the tailoring mechanism of the sleeve maker.

As shown in FIGS. 29-31, the tailoring mechanism 143 according to one or more embodiments includes a tailoring mechanism rack 1431, a left side tailoring device 1432, a blanking device 1433, a right side tailoring device 1434, a left side tailoring bottom plate 1435 and a right side tailoring bottom plate 1436. The left side tailoring device 1432 includes a left side tailoring cylinder 14321, a left side tailoring cutter die connecting plate 14322, a left side tailoring cutter die 14323 and a cutter 143221. The blanking device 1433 includes a blanking cylinder 14331 and a blanking push plate 14332. The right side tailoring device 1434 includes a right side tailoring cylinder 14341, a right side tailoring cutter die connecting plate 14342 and a right side tailoring cutter die 14343. Similarly, a cutter which is in a same structure with the cutter 143221 on the left side and is a little longer than the cutter 143221 is still arranged at the bottom of the right side tailoring cutter die 14343 on the right side and is not shown in the figures.

The left side tailoring cylinder 14321 and the right side tailoring cylinder 14341 are symmetrically arranged at the top of the tailoring mechanism rack 1431, the blanking cylinder 14331 is arranged at the middle position of the top of the tailoring mechanism rack 1431, and the left side tailoring bottom plate 1435 and the right side tailoring bottom plate 1436 are symmetrically arranged on the two sides of the bottom of the tailoring mechanism rack 1431.

The bottom of the left side tailoring cylinder 14321 is connected to the top of the left side tailoring cutter die connecting plate 14322, the bottom of the left side tailoring cutter die connecting plate 14322 is connected to the top of the left side tailoring cutter die, the cutter 143221 is arranged at the bottom of the left side tailoring cutter die 14323, and the bottom of the blanking cylinder 14331 is connected to the top of the blanking push plate 14332. The structure of the right side tailoring device 1434 and the structure of the left side tailoring device 1432 are same and are not described herein.

The two-layer sleeve cloth enters the tailoring mechanism after the two cuts in the length direction of the sleeve are cut by the die cutting mechanism, and the purpose of the tailoring mechanism is that two ends of the sleeve are tailored down, so that the previous cuts are separated from the cloth, so as to form a sleeve barrel.

Figure 32:
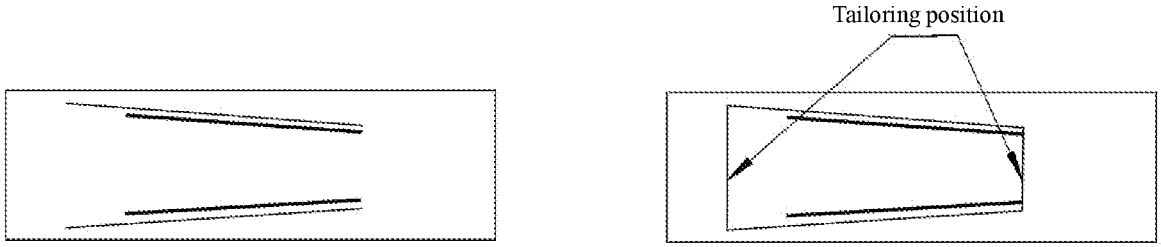
FIG. 32 shows states of two-layer sleeve cloth before and after being processed by the tailoring mechanism.

The specific process is described as follows: when the cloth passes the tailoring mechanism 143, the tailoring cylinder moves downwards to drive the tailoring cutter die connecting plate connected to the bottom of the tailoring cylinder to move downwards, the cutter connected to the tailoring cutter die moves downwards to tailor the two ends of the sleeve, and at the same time, the blanking cylinder moves downwards to drive the blanking push plate connected to the bottom of the blanking cylinder to move downwards, so as to push the sleeve tailored down onto the sleeve transferring mechanism. FIG. 32 shows states of the two-layer sleeve cloth before and after being processed by the tailoring mechanism. It can be seen from the figure that the sleeve barrel is formed at the moment; and the appearance of the blanking push plate which is not pushed is schematically shown in the figure.

Figure 33:
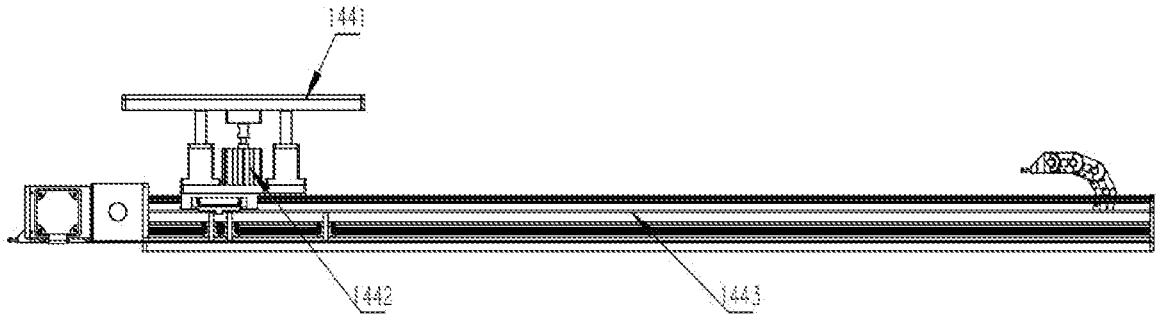
FIG. 33 shows a structural schematic diagram of a sleeve transferring mechanism of the sleeve maker according to one or more embodiments.

FIG. 33 shows a structural schematic diagram of the sleeve transferring mechanism of the sleeve maker according to one or more embodiments. As shown in FIG. 33, the sleeve transferring mechanism 144 according to one or more embodiments includes a sleeve support platform 1441, a sleeve support platform cylinder 1442 and a sleeve mobile mechanism guide rail 1443.

The sleeve support platform cylinder 1442 is arranged on one side of the sleeve mobile mechanism guide rail 1443, and the top of the sleeve support platform cylinder 1442 is connected to the bottom of the sleeve support platform 1441.

The sleeve tailored down by the tailoring mechanism is blanked onto the sleeve support platform 1441, the sleeve support platform 1441 is driven by a motor to move on the sleeve mobile mechanism guide rail 1443 to the welding position of the sleeve, and the sleeve support platform cylinder 1442 is used for adjusting the height of the sleeve support platform 1441.

Figure 34:
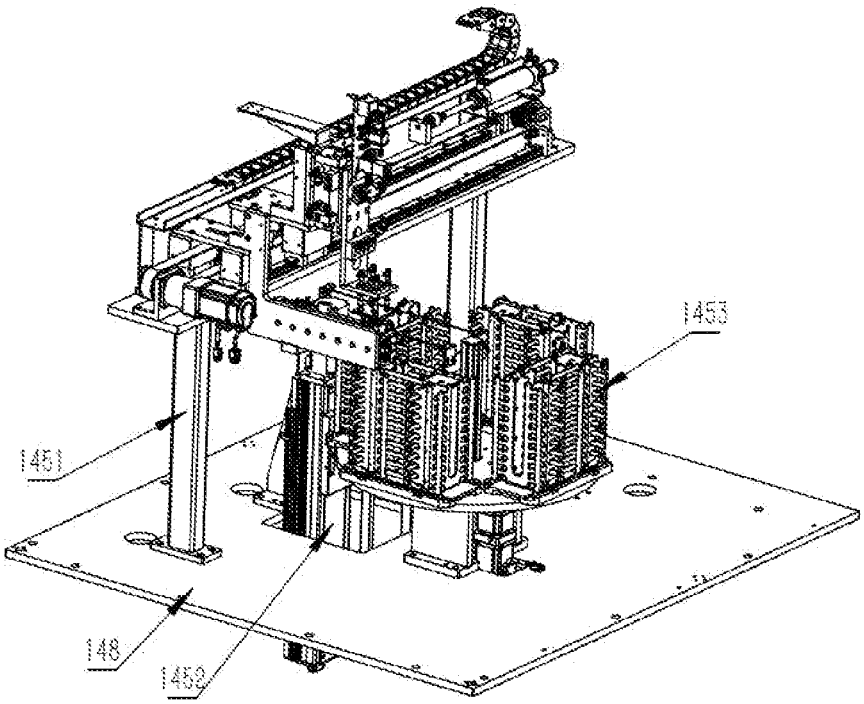
FIG. 34 shows a structural schematic diagram of a sleeve head taking mechanism according to one or more embodiments.
Figure 35:
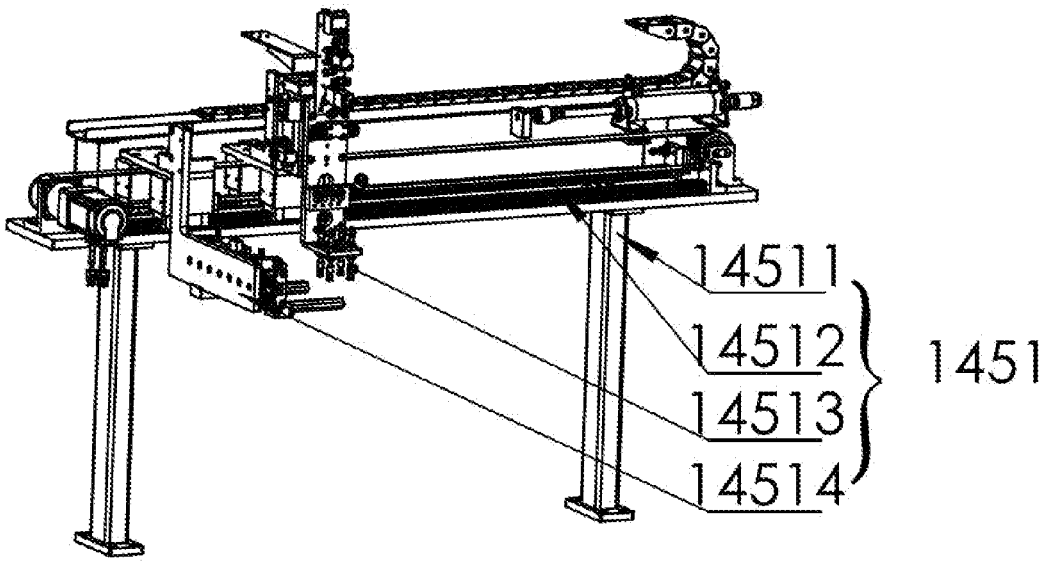
FIG. 35 shows a structural schematic diagram of a sleeve head suction cup mobile mechanism according to one or more embodiments.
Figure 36:
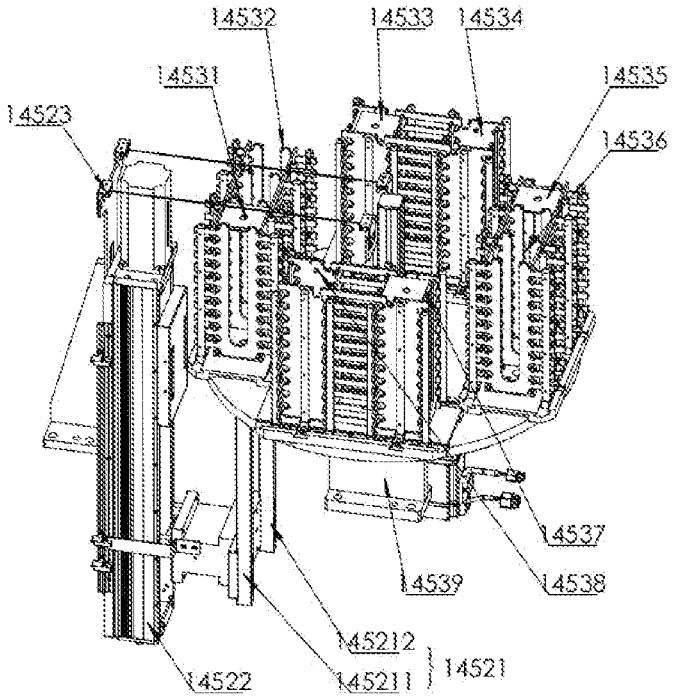
FIG. 36 shows a structural schematic diagram of a sleeve head storing mechanism according to one or more embodiments.

FIG. 34 shows a structural schematic diagram of the sleeve head taking mechanism according to one or more embodiments. According to one or more embodiments, the sleeve head may be taken and moved by a suction cup mobile mechanism. In another embodiment, a cylinder gripper mechanism may be used to take and move the sleeve head. FIG. 35 shows a structural schematic diagram of a sleeve head suction cup mobile mechanism according to one or more embodiments. FIG. 36 shows a structural schematic diagram of a sleeve head storing mechanism according to one or more embodiments.

As shown in FIGS. 34-36, the sleeve head taking mechanism 145 includes the sleeve head suction cup mobile mechanism 1451, a sleeve head ejection mechanism 1452 and the sleeve head storing mechanism 1453.

The sleeve head suction cup mobile mechanism 1451 includes a sleeve head suction cup mobile mechanism rack 14511, a sleeve head suction cup mobile platform 14512, a sleeve head suction cup 14513 and a sleeve head opening mechanism 14514.

The sleeve head ejection mechanism 1452 includes a sleeve head ejection rod 14521 (including a left side sleeve head ejection rod 145211 and a right sleeve head ejection rod 145212), a sleeve head ejection rod mobile guide rail 14522 and a sleeve head remainder detection optoelectronic switch 14523. The switch is arranged on the sleeve head ejection mechanism 1452, is used for detecting a sleeve head remainder and is convenient to install.

The sleeve head storing mechanism 1453 includes a plurality of sleeve head storing devices 14531-15538 and a sleeve head storing device rotating platform 14539.

The sleeve head suction cup mobile mechanism rack 14511 is arranged at the top of the rack 148, the sleeve head ejection mechanism 1452 is arranged at the middle position of the rack 148, the bottom of the sleeve head storing mechanism 1453 is connected to the top of the rack 148, the sleeve head suction cup 14513 and the sleeve head opening mechanism 14514 are arranged on the sleeve head suction cup mobile platform 14512, and the bottoms of the sleeve head storing devices 14531-15538 are connected to a top plate of the sleeve head storing device rotating platform 14539.

The sleeve head suction cup 14513 is moved to the top of the sleeve head storing device 14531 by the sleeve head suction cup mobile platform 14512, then the left side sleeve head ejection rod 145211 and the right sleeve head ejection rod work simultaneously and are moved upwards by the sleeve head ejection rod mobile guide rail 14522 to push a sleeve head to the sleeve head suction cup, then the sleeve head is sucked by the sleeve head suction cup, and the sleeve head suction cup is moved to the next station (the sleeve head is sleeved on a sleeve head support block.) by the sleeve head suction cup mobile platform 14512. A sleeve head remainder detection optoelectronic device is used for automatically monitoring the sleeve head remainder, the sleeve head suction cup 14513 is used for taking sleeve heads from the sleeve head storing device 14531 and the sleeve head storing device 14532, and after the sleeve heads are taken, the sleeve head storing device rotating platform 14539 rotates 90 degrees to deliver sleeve heads at the next station to the position which is below the sleeve head suction cup 14513. According to the one embodiment of the present invention, a plurality of sleeve head storing devices work, and when one sleeve head storing device works, the sleeve heads can be added into other storing devices, thereby ensuring continuous operation. The sleeve head remainder detection optoelectronic switch is arranged on the sleeve head ejection mechanism 1452, so that the number of the sleeve head remainder detection optoelectronic switch can be reduced.

According to another embodiment, each of the sleeve head storing devices is provided with a sleeve head remainder detection optoelectronic device, the sleeve head remainder detection optoelectronic device is used for monitoring the remainder of the sleeve head in the sleeve head storing device, and when the sleeve head in the current sleeve head storing device used for supplying the sleeve head is used out, the sleeve head storing device rotating platform rotates to enable the next sleeve head storing device to become the current sleeve head storing device used for supplying the sleeve head.

Figure 37:
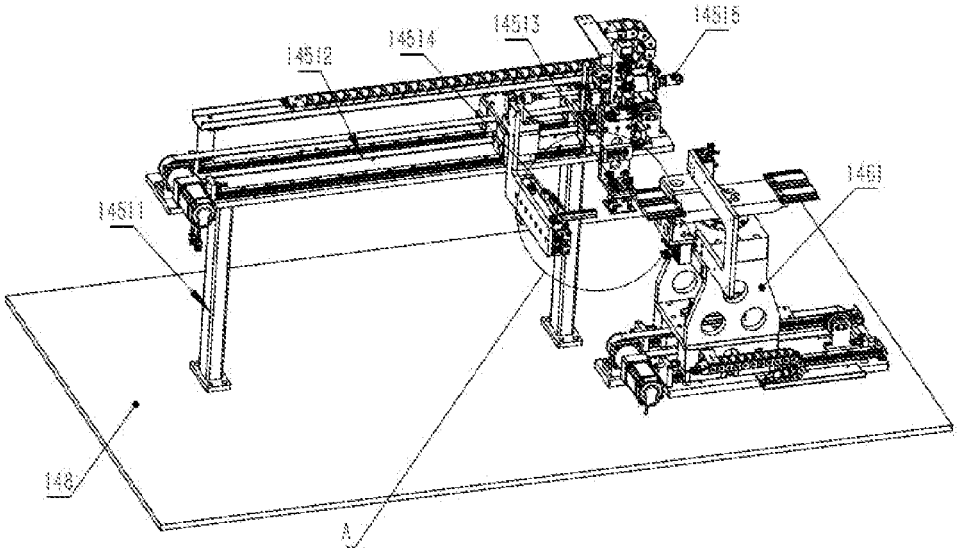
FIG. 37 shows a structural schematic diagram of a sleeve head mobile mechanism of the sleeve maker according to one or more embodiments.
Figure 38:
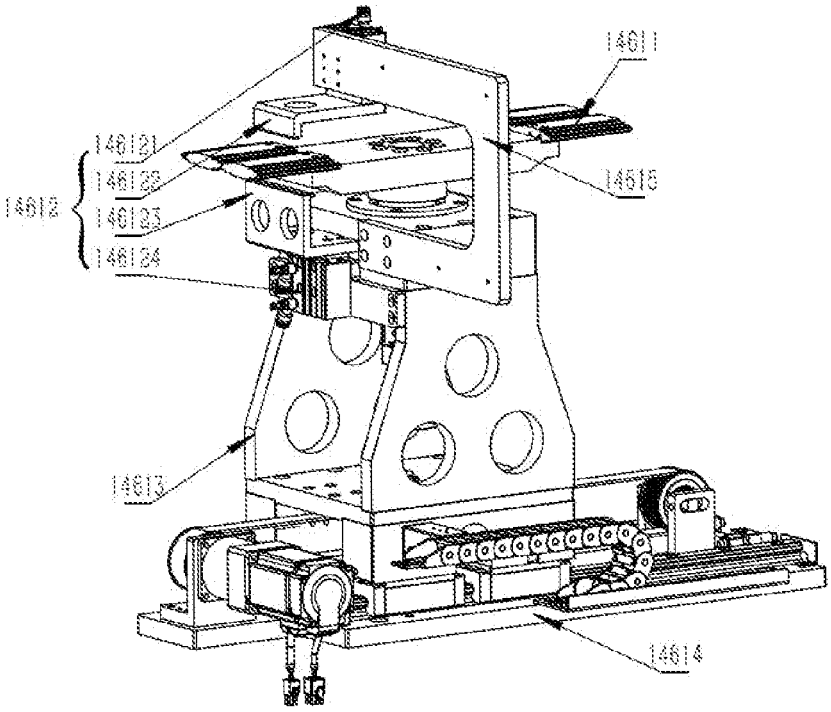
FIG. 38 shows a structural schematic diagram of a sleeve head mobile rotating platform.

FIG. 37 shows a structural schematic diagram of the sleeve head mobile mechanism of the sleeve maker according to one or more embodiments; FIG. 38 shows a structural schematic diagram of a sleeve head mobile rotating platform; and FIG. 39 shows an enlarged view of a position A in FIG. 37.

Figure 39:
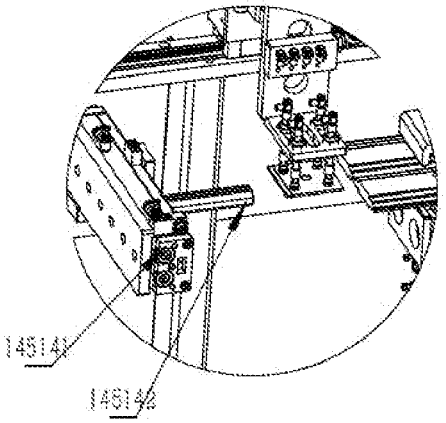
FIG. 39 shows an enlarged view of a position A in FIG. 37.

As shown in FIGS. 37-39, the sleeve head mobile mechanism 146 includes the sleeve head mobile rotating platform 1461. The sleeve head mobile rotating platform 1461 includes the sleeve head support block 14611, a sleeve head locating mechanism 14612, a mobile rotating platform rack 14613, a mobile platform 14614 and a sleeve head locating mechanism bracket 14615. The sleeve head locating mechanism 14612 includes a sleeve head locating mechanism upper cylinder 146121, a sleeve head locating mechanism upper baffle block 146122, a sleeve head locating mechanism lower baffle block 146123 and a sleeve head locating mechanism lower cylinder 146124.

The top of the rack 148 is connected to the bottom of the sleeve head suction cup mobile mechanism rack 14511, the bottom of the mobile platform 14614 is connected to the top of the rack 148, the bottom of the mobile rotating platform rack 14613 is connected to the top of the mobile platform 14614, and the mobile platform 14614 is fixed on the rack 148.

The sleeve head suction cup 14513 and the sleeve head opening mechanism 14514 are arranged on the sleeve head suction cup mobile platform 14512, the sleeve head opening mechanism 14514 is connected to one end of a sleeve head opening mechanism driving cylinder 14515, the bottom of the sleeve head support block 14611 is connected to a motor and is arranged at the top of the mobile rotating platform rack 14613, the sleeve head locating mechanism bracket 14615 is arranged on one side of the top of the mobile rotating platform rack 14613, the sleeve head locating mechanism upper cylinder 146121 is arranged at the upper part of the sleeve head locating mechanism bracket 14615, the bottom of the sleeve head locating mechanism upper cylinder 146121 is connected to the top of the sleeve head locating mechanism upper baffle block 146122, the sleeve head locating mechanism lower cylinder 146124 is arranged at the lower part of the sleeve head locating mechanism bracket 14615, the top of the sleeve head locating mechanism lower cylinder 146124 is connected to the bottom of the sleeve head locating mechanism lower baffle block 146123, and a sleeve head support rod cylinder 145141 is connected to a sleeve head support rod 145142.

After the sleeve head is sucked by the sleeve head suction cup 14513, the sleeve head suction cup 14513 moves to the left side of the sleeve head support block 14611, the sleeve head opening mechanism 14514 is driven by the sleeve head opening mechanism driving cylinder 14515 at the moment to move on the sleeve head suction cup mobile platform 14512 to the left side of the sleeve head suction cup 14513 and is inserted into the sleeve head, the sleeve head support rod cylinder 145141 drives the sleeve head support rod 145142 to open, so that the sleeve head is opened, then the sleeve head opening mechanism 14514 moves forwards and is used for sleeving the opened sleeve head on the sleeve head support block 14611, the sleeve head locating mechanism upper cylinder 146121 moves downwards to drive the sleeve head locating mechanism upper baffle block 146122 connected to the sleeve head locating mechanism upper cylinder 146121 to move downwards, the sleeve head locating mechanism lower cylinder 146122 moves upwards to drive the sleeve head locating mechanism lower baffle block 146123 connected to the sleeve head locating mechanism lower cylinder 146122 to move upwards at the same time, and the sleeve head locating mechanism 14612 is mainly used for compressing the sleeve head sleeved on the sleeve head support block 14611 up and down (up and down refer to an upper surface and a lower surface of the sleeve head.). As the sleeve head is an elastic object, the sleeve head is sleeved on the sleeve head support block after the sleeve head is opened, at the moment, the sleeve head opening mechanism 14514 can be successfully pulled out after the sleeve head is compressed by the sleeve head locating mechanism 14612, and the sleeve head opening mechanism 14514 is difficultly pulled out without compression.

After the sleeve head is sleeved on the sleeve head support block 14611, the sleeve head support block 14611 is driven by a bottom motor to rotate 180 degrees, and then the sleeve head mobile rotating platform 1461 is moved to the subsequent welding position by the mobile platform 14614.

Figure 40:
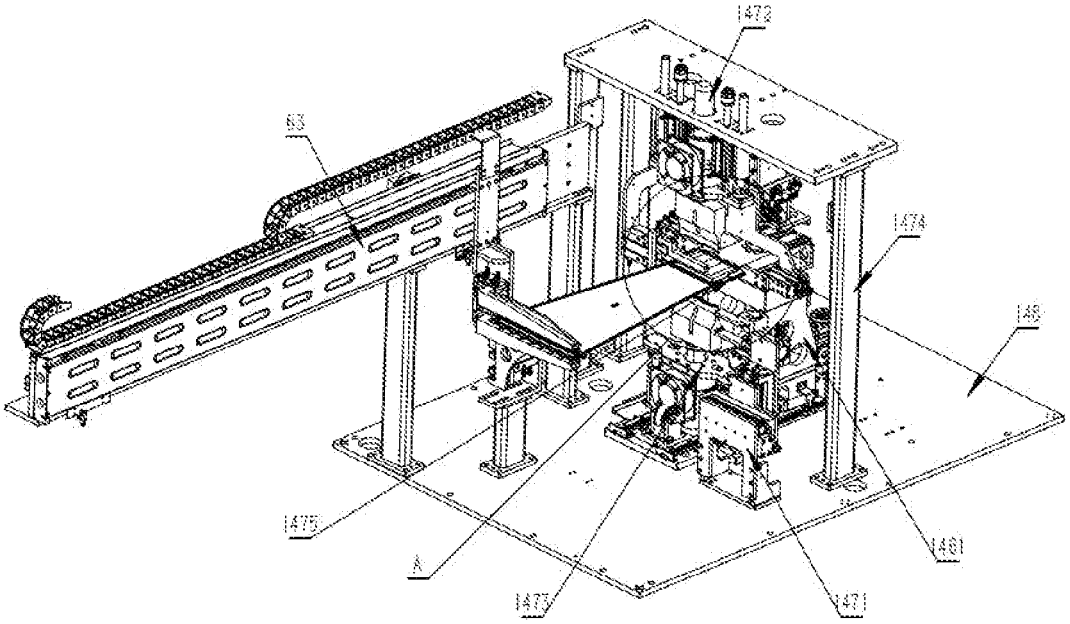
FIG. 40 shows a structural schematic diagram of work of a sleeve head welding mechanism according to one or more embodiments.
Figure 41:
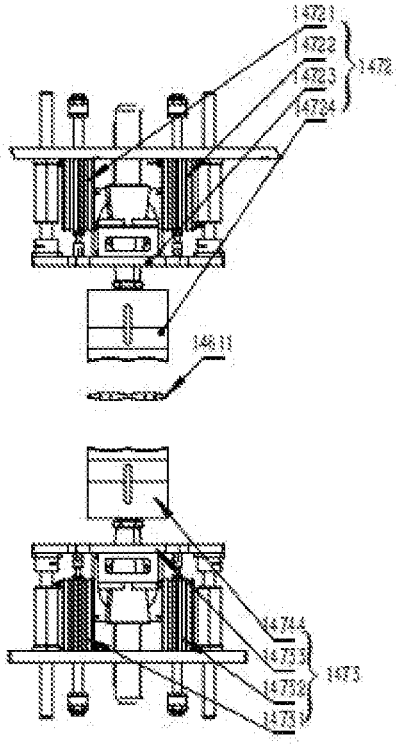
FIG. 41 shows a structural schematic diagram of a sleeve head welding die according to one or more embodiments.
Figure 42:
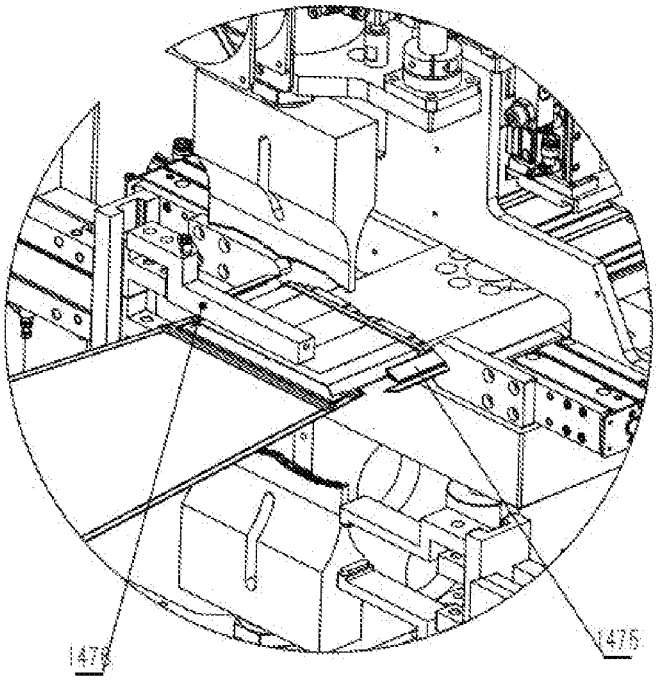
FIG. 42 shows an enlarged view of a position A in FIG. 40.

FIG. 40 shows a structural schematic diagram of work of the sleeve head welding mechanism according to one or more embodiments. FIG. 41 shows a structural schematic diagram of a sleeve head welding die according to one or more embodiments. FIG. 42 shows an enlarged view of a position A in FIG. 40.

As shown in FIGS. 40-42, the sleeve head welding mechanism according to one or more embodiments includes a sleeve welding locating mechanism 1471, an upper part welding die 1472, a lower part welding die 1473, a welding die rack 1474, cuff opening mechanisms 1475 and a sleeve suction clamping device 1476.

The upper part welding die 1472 includes an upper part welding die left cylinder 14721, an upper part welding die right cylinder 14722, an upper part welding die head fixing plate 14723 and an upper part welding die head 14724.

The lower part welding die 1473 includes a lower part welding die left cylinder 14731, a lower part welding die right cylinder 14732, a lower part welding die head fixing plate 14733 and a lower part welding die head 14734.

The bottom of the welding die rack 1474 is arranged at the top of the rack 148, the upper part welding die left cylinder 14721 and the upper part welding die right cylinder 14722 are symmetrically arranged on the two sides of the top of the welding die rack 1474, the upper part welding die head 14724 is arranged at the middle position of the upper part welding die head fixing plate 14723, the lower part welding die left cylinder 14731 and the lower part welding die right cylinder 147322 are symmetrically arranged at the top of the rack 148, and the lower part welding die head 14734 is arranged at the middle position of the lower part welding die head fixing plate 14733. The cuff opening mechanisms 1475 are arranged on the left side and the right side of the welding die (including the upper part welding die 1472 and the lower part welding die 1473) and are connected to the top of the rack 148.

Figure 43:
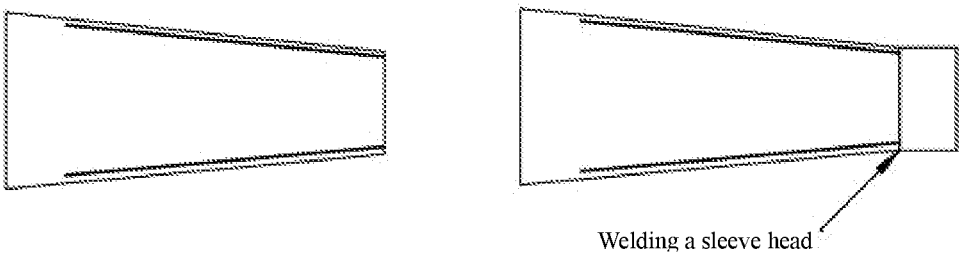
FIG. 43 shows states of two-layer sleeve cloth before and after being processed by the sleeve head welding mechanism.

When in work, the sleeve suction clamping device 1476 is used for sucking a cuff by a suction cup, the cuff is opened to form a small opening, the sleeve head support block sleeved by the sleeve head can be successfully instead into the cuff, a mechanical claw is arranged on the sleeve welding locating mechanism 1471, the mechanical claw is used for clamping one side of the sleeve for locating, the cuff opening mechanism 1475 is inserted into the cuff and moves to two sides to open the cuff, then the sleeve head support block 14611 sleeved by the sleeve head is inserted into the sleeve, the upper welding die cylinders move downwards to drive the upper part welding die head fixing plate 14723 connected to the bottom of the upper welding die cylinders to move downwards, and the upper part welding die head fixing plate 14723 moves downwards to drive the upper part welding die head 14724 to move downwards. Similarly, the lower welding die head moves upwards, convex shapes are formed on the upper part welding die head 14724 and the lower part welding die head 14734, the upper side and the lower side of the sleeve head support block 14611 are in concave shape, an interval is formed between the sleeve and the sleeve head when the sleeve head is inserted into the sleeve, and the sleeve and the sleeve head can be tightened to the middle when in welding by adopting the shapes, thereby ensuring the sealing property of the welding of the sleeve and the sleeve head. FIG. 43 shows states of the two-layer sleeve cloth before and after being processed by the sleeve head welding mechanism.

The produced sleeves as well as the front body cloth, the left rear body cloth and the right rear body cloth are delivered to the sleeve welding device 6.

Figure 44:
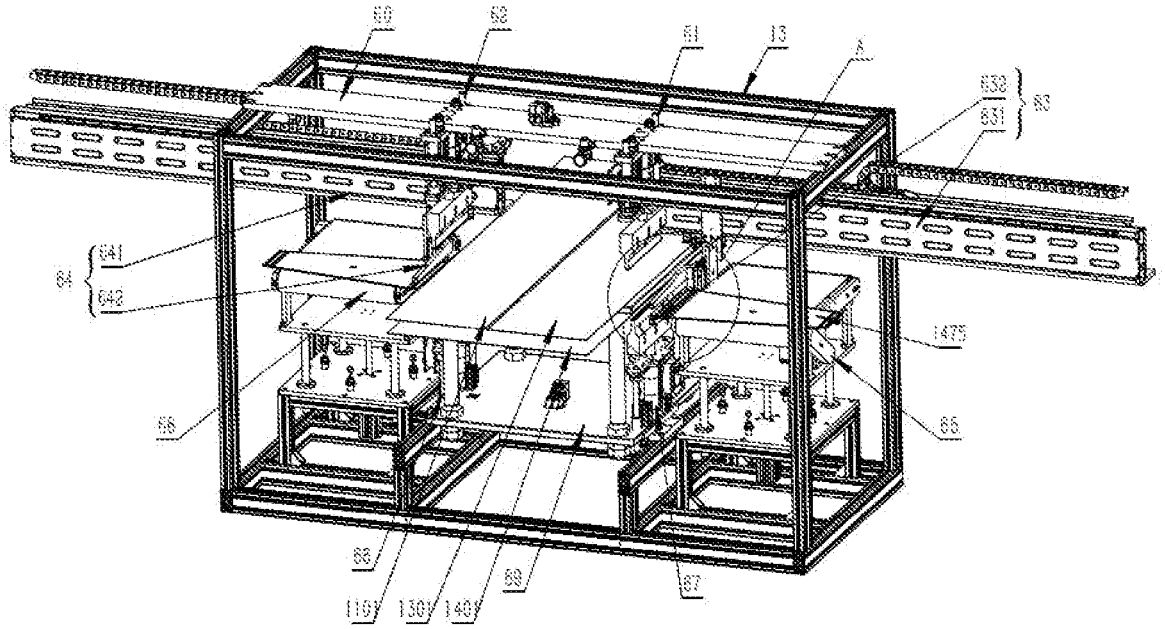
FIG. 44 shows a structural schematic diagram of a sleeve welding device according to one or more embodiments.
Figure 45:
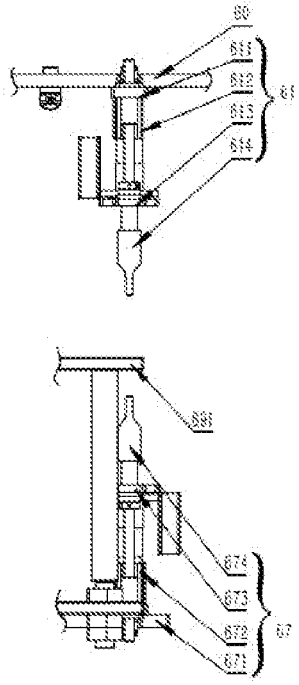
FIG. 45 shows a structural schematic diagram of a welding die of the sleeve welding device according to one or more embodiments.
Figure 46:
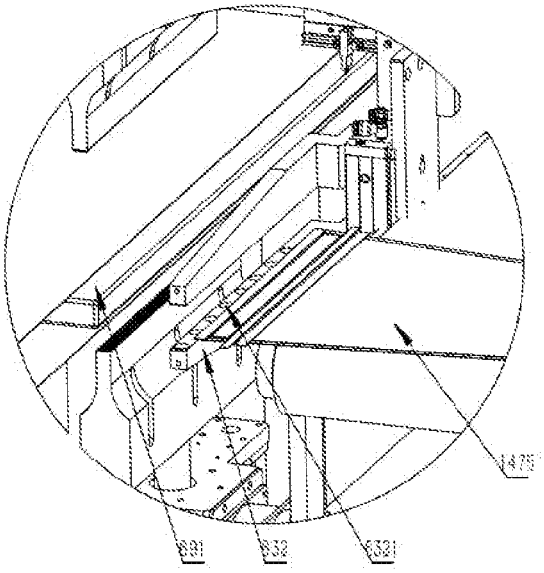
FIG. 46 shows an enlarged view of a position A in FIG. 44.

FIG. 44 shows a structural schematic diagram of the sleeve welding device according to one or more embodiments. FIG. 45 shows a structural schematic diagram of a welding die of the sleeve welding device according to one or more embodiments. FIG. 46 shows an enlarged view of a position A in FIG. 44.

As shown in FIGS. 45-46, the sleeve welding device 6 includes an upper side welding die fixing plate 60, an upper side right welding die 61, an upper side left welding die 62, a right side sleeve feeder 63, a left side sleeve feeder 64, a right side liftable transmission belt 65, a left side liftable transmission belt 66, a lower side right welding die 67, a lower side left welding die 68 and a body locating plate 69.

The upper side right welding die 61 includes upper side welding die cylinder fixing plates 611, upper side welding die cylinders 612, an upper side welding die head fixing plate 613 and an upper side welding die head 614; and the lower side right welding die 67 includes lower side welding die cylinder fixing plates 671, lower side welding die cylinders 672, a lower side welding die head fixing plate 673 and a lower side welding die head 674. The body locating plate 69 includes a plurality of bottom plates and an upper plate 691, and the bottom plates are connected to each other by column bodies. The right side sleeve feeder 63 includes a right side sleeve suction clamping mechanical arm mobile platform 631 and a right side sleeve suction clamping mechanical arm 632 (including a sleeve suction clamping mechanical arm suction cup 6321). The left side sleeve feeder 64 includes a left side sleeve suction clamping mechanical arm mobile platform 641 and a left side sleeve suction clamping mechanical arm 642.

Figure 47:
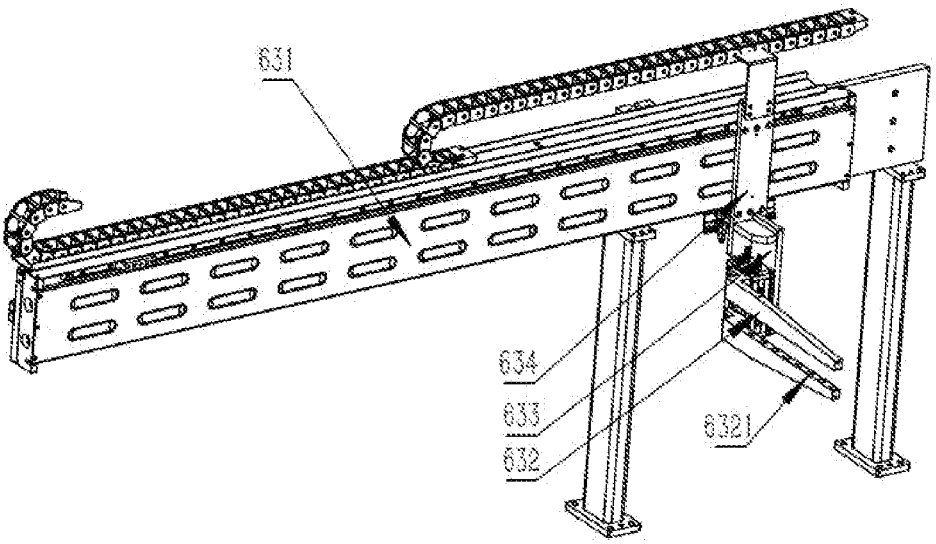
FIG. 47 shows a structural schematic diagram of a sleeve feeder according to one or more embodiments.

FIG. 47 shows a structural schematic diagram of the right side sleeve feeder according to one or more embodiments. As shown in FIG. 47, the right side sleeve feeder 63 includes the sleeve suction clamping mechanical arm mobile platform 631, the sleeve suction clamping mechanical arm 632, a sleeve suction clamping mechanical arm cylinder used for driving the sleeve suction clamping mechanical arm 632, and a sleeve suction clamping mechanical arm bracket 634 used for arranging the sleeve suction clamping mechanical arm mobile platform 631, the sleeve suction clamping mechanical arm 632 and the sleeve suction clamping mechanical arm cylinder (the structure of the left side sleeve feeder 64 is the same as that of the right side sleeve feeder 63 and is not described herein.).

The top of the rear rack 13 is connected to the bottom of the upper side welding die fixing plate 60, the upper side welding die cylinder fixing plates 611 are symmetrically arranged on the two sides of the upper side welding die fixing plate 60, the tops of the upper side welding die cylinders 612 are arranged at the bottoms of the upper side welding die cylinder fixing plates 611, the bottom of the upper side welding die cylinders 612 are connected to the upper side welding die head fixing plate 613, and the upper side welding die head fixing plate 613 can be pushed to reciprocate up and down. The upper side welding die head 614 is arranged at the middle position of the upper side welding die head fixing plate 613 and can reciprocate up and down along the upper side welding die head fixing plate 613.

The right side liftable transmission belt 65 and the left side liftable transmission belt 66 are symmetrically arranged at the bottom of the rear rack 13, the right side sleeve feeder 63 and the left side sleeve feeder 64 are symmetrically arranged at the bottom of the rear rack 13, and the bottom plates of the body locating plate 69 are arranged at the bottom of the rear rack 13.

The lower side welding die cylinder fixing plates 671 are arranged on the bottom plates of the body locating plate 69, the bottoms of the lower side welding die cylinders 672 are symmetrically arranged at the tops of the lower side welding die cylinder fixing plates 671 (in one or more embodiments, the number of the cylinders may be two: one cylinder is arranged on one side of the welding die head, the other cylinder is arranged on the other side of the welding die head, and the two cylinders are symmetrical along the central axis of the lower side welding die head 674), the tops of the lower side welding die cylinders 672 are connected to the bottom of the lower side welding die head fixing plate 673, and the lower side welding die head fixing plate 673 can be pushed to reciprocate up and down. The lower side welding die head 674 is arranged at the middle position of the lower side welding die head fixing plate 673 and can reciprocate up and down along the lower side welding die head fixing plate 673.

Figure 48:
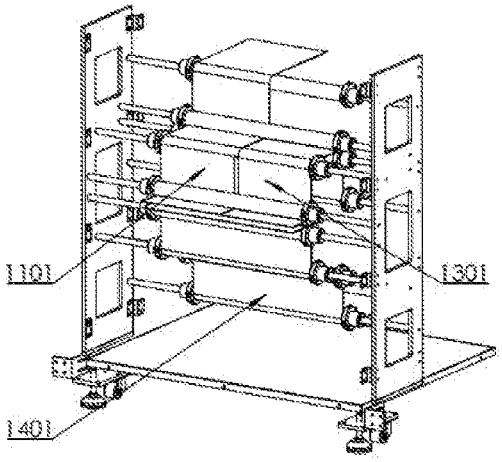
FIG. 48 shows a schematic diagram of a combination device according to one or more embodiments.

The right rear body cloth 1101 of the clothing, the left rear body cloth 1301 of the clothing and the front body cloth 1401 of the clothing are combined (referred to as "combined body cloth") and then moved to the welding positions of the sleeves. The combination is realized mainly by virtue of guiding of the guide roller, and the combination device is used for collecting the front body cloth 1401 of the clothing, the right rear body cloth 1101 of the clothing and the left rear body cloth 1301 of the clothing after being guided by the guide roller. FIG. 48 shows a schematic diagram of the combination device according to one or more embodiments. The device is arranged between the tailoring device 5 and the sleeve welding device 6. The right side sleeve suction clamping mechanical arm 632 and the left side sleeve suction clamping mechanical arm 642 are respectively used for conveying the sleeves to the welding positions by the right side sleeve suction clamping mechanical arm mobile platform 631 and the left side sleeve suction clamping mechanical arm mobile platform 641. The right side sleeve suction clamping mechanical arm 632 and the left side sleeve suction clamping mechanical arm 642 are respectively provided with one or more sleeve suction clamping mechanical arm suction cups (only the right side sleeve suction clamping mechanical arm suction cup 6321 is shown; the "suction cups" hereinafter). The suction cup is used for sucking a sleeve to open the sleeve, and the sleeve is inserted into the body (i.e., a combination of the front body cloth, the left rear body cloth, and the right rear body cloth). An opening of the sleeve is reserved. As the sleeve is welded on the outer side of the clothing, if the sleeve is completely welded, the sleeve would not open after being sucked up, and therefore cannot be inserted into the clothing for welding (a cylindrical shape cannot be inserted into the cloth, and the sleeve can be inserted into the cloth only after the opening is reserved). The sleeve is sucked by the suction cup and is inserted into the body as the opening is reserved; the sleeve suction clamping mechanical arm is used; and the welding can be realized by inserting several centimeters of the sleeve into the body. In one or more embodiments, the reserved opening may be ⅓ of the length of the sleeve. In another embodiment, the process of moving the sleeves to the welding positions, opening the sleeves, and inserting the sleeves into the body clothing may be performed by a pneumatic clamping arm mechanism. During the process, the right side liftable transmission belt 65 and the left side liftable transmission belt 66 move downwards for the purpose that the movement of the sleeve suction clamping mechanical arms is not affected. When the sleeves to the welding positions, the right side liftable transmission belt 65 and the left side liftable transmission belt 66 move upwards to realize a support work for the sleeves. The two belts may have the following functions of a liftable function, a function of ensuring the sleeves to be transferred forwards and a support function, wherein mainly when the sleeve suction clamping mechanical arms move to the positions, the belts move downwards, so as not to affect the sleeve suction clamping mechanical arms to pull the sleeves to move to the welding positions. If the sleeves are not supported by the belts on the two sides, the sleeves may drop, so as to affect forward transmission and finally affect the sleeves to enter the cloth folder 11; and before the sleeves enter the cloth folder 11, the sleeves and the body part are ensured to be leveled in a same horizontal plane.

Figure 49:
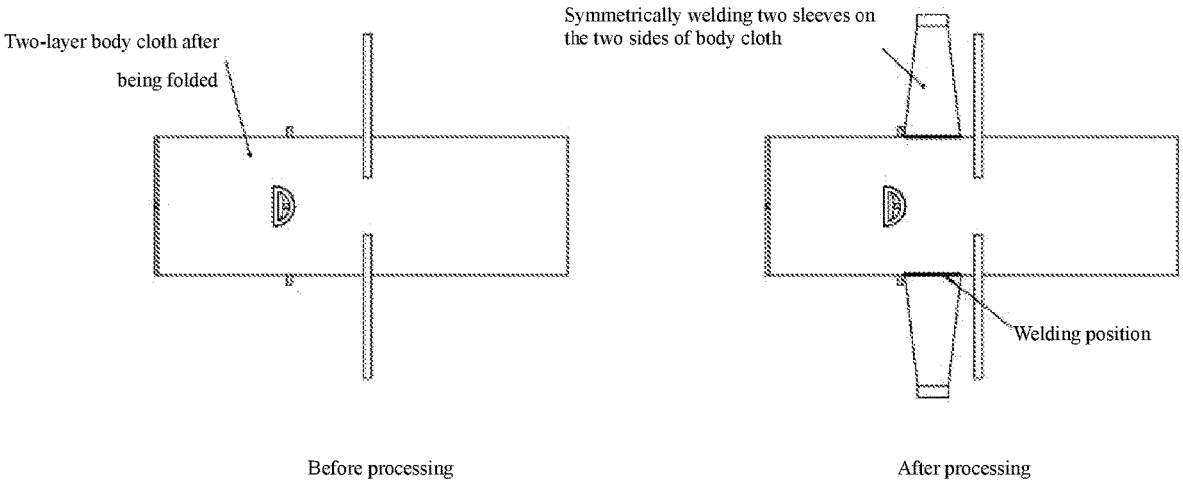
FIG. 49 shows states of cloth before and after being processed by the sleeve welding device.

Then, the upper side welding die cylinders 612 work to drive the upper side welding die head fixing plate 613 connected to the upper side welding die cylinders 612 to move downwards, and the upper side welding die head 614 connected to the middle position of the upper side welding die head fixing plate 613 moves downwards; and at the same time, the lower side welding die cylinders 672 work to drive the lower side welding die head fixing plate 673 connected to the lower side welding die cylinders 672 to move upwards, the lower side welding die head 674 connected to the middle position of the lower side welding die head fixing plate 673 moves upwards, and ultrasonic fusion welding is carried out on the body and the sleeves on the two sides of the body locating plate 69. FIG. 49 shows states of the cloth before and after being processed by the sleeve welding device.

After the sleeves are welded with the front body cloth and the rear piece cloth, the supplementary sleeve welding device welds and seals the left sleeve and the right sleeve onto the combined body cloth.

Figure 50:
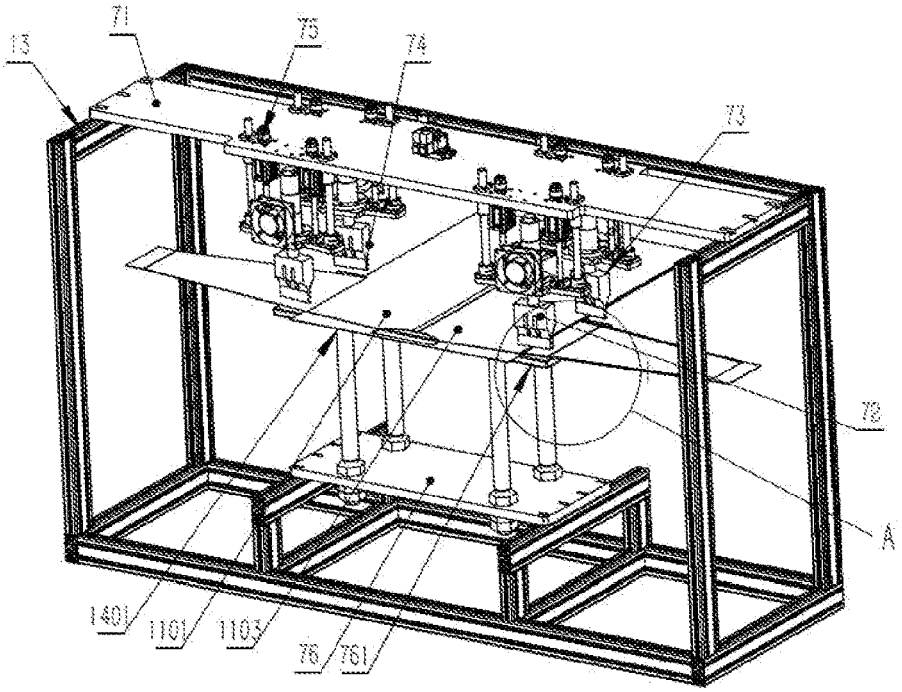
FIG. 50 shows a structural schematic diagram of a supplementary sleeve welding device according to one or more embodiments.
Figure 51:
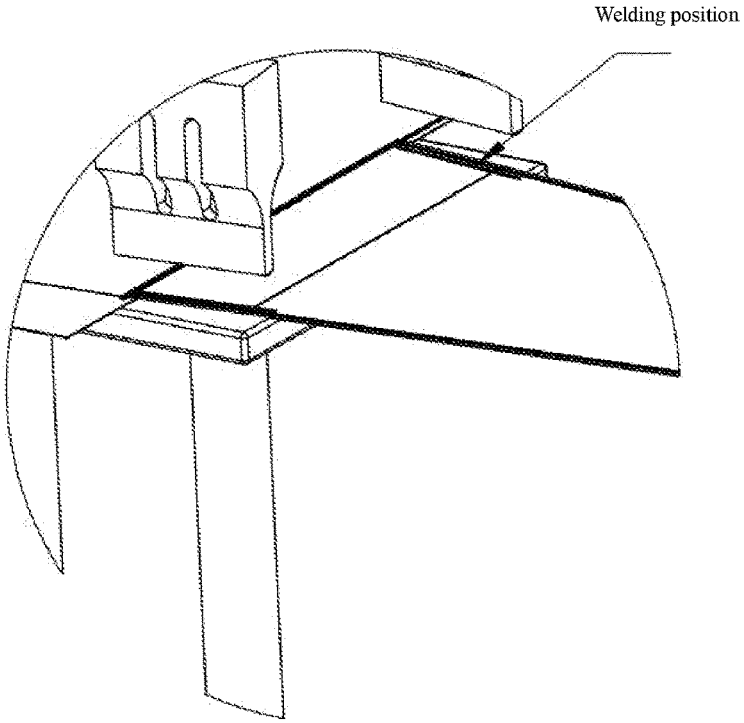
FIG. 51 shows a schematic diagram of a supplementary sleeve welding position.

FIG. 50 shows a structural schematic diagram of the supplementary sleeve welding device according to one or more embodiments. FIG. 51 shows a schematic diagram of a supplementary sleeve welding position.

As shown in FIG. 50, according to one or more embodiments, the supplementary sleeve welding device 7 includes a welding die fixing plate 71, a right side sleeve first welding die 72, a right side sleeve second welding die 73, a left side sleeve first welding die 74, a left side sleeve second welding die 75 and a body locating plate 76. The body locating plate 76 includes a bottom plate, a plurality of circular columns and a body locating plate upper plate 761.

The top of the rear rack 13 is connected to the bottom of the welding die fixing plate 71; the right side sleeve first welding die 72, the right side sleeve second welding die 73, the left side sleeve first welding die 74 and the left side sleeve second welding die 75 are connected to the bottom of the welding die fixing plate 71; and the bottom of the body locating plate 76 is arranged at the bottom of the rear rack 13.

Figure 52:
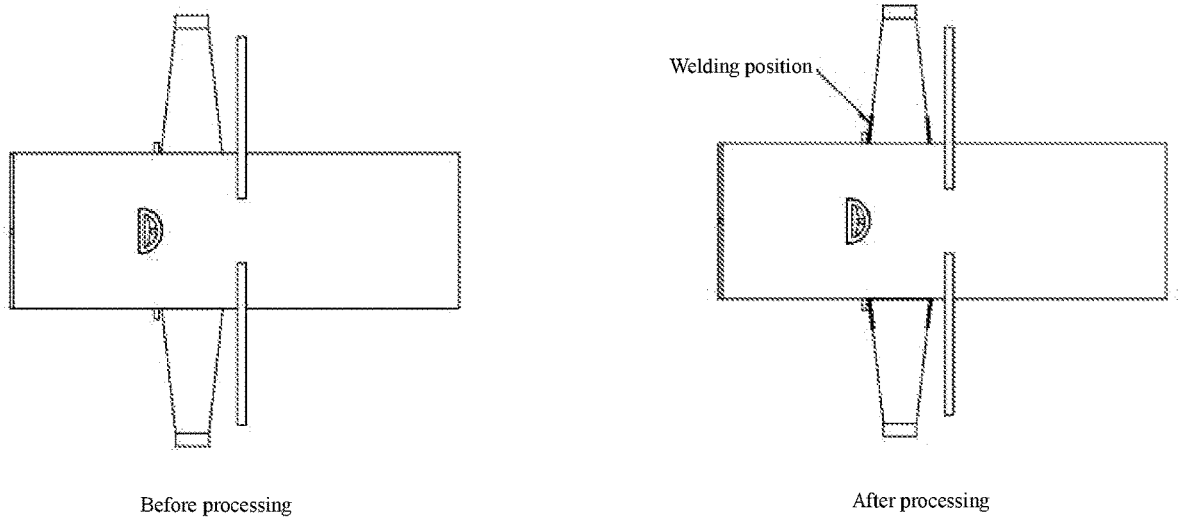
FIG. 52 shows schematic diagrams of cloth before and after being processed by the supplementary sleeve welding device.

When the cloth of the clothing is moved to the position by a driving device, the four welding dies connected to the welding die fixing plate 71 move downwards, and ultrasonic fusion welding is carried out on unwelded parts of the sleeves of the clothing above the body locating plate upper plate 761. According to one embodiment, the driving device is controlled by the PLC, the servo motor of the driving device is provided with the encoder for calculating the moving distance of the clothing, and the welding position is determined by virtue of every moving distance of the cloth; remaining reserved positions (for example, the remaining ⅓ position) of the sleeves are welded by the four dies; and the welding positions are located by virtue of the moving distance of the cloth. FIG. 52 shows schematic diagrams of the cloth before and after being processed by the supplementary sleeve welding device.

Figure 53:
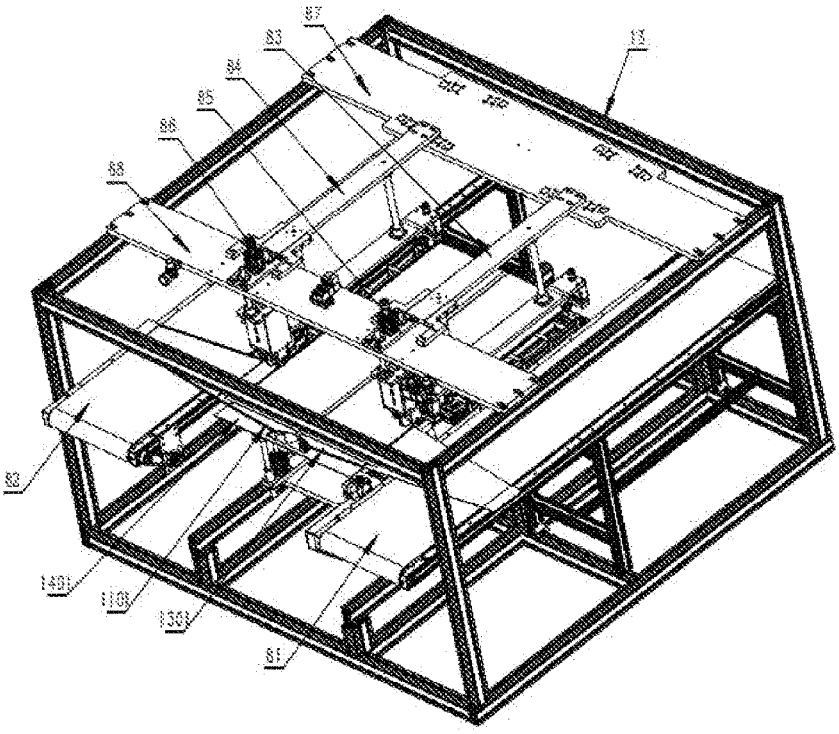
FIG. 53 shows a structural schematic diagram of a body welding device according to one or more embodiments.
Figure 54:
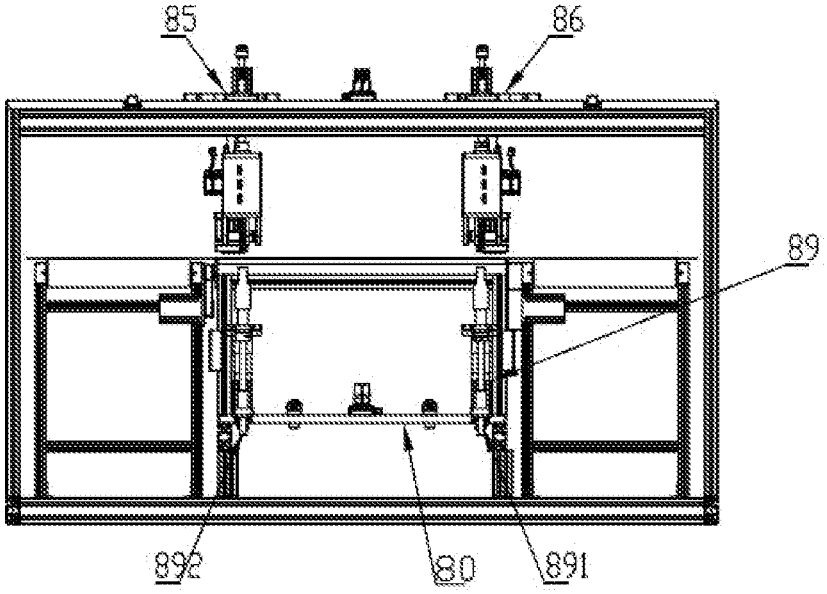
FIG. 54 shows a side view of the body welding device according to one or more embodiments.
Figure 55:
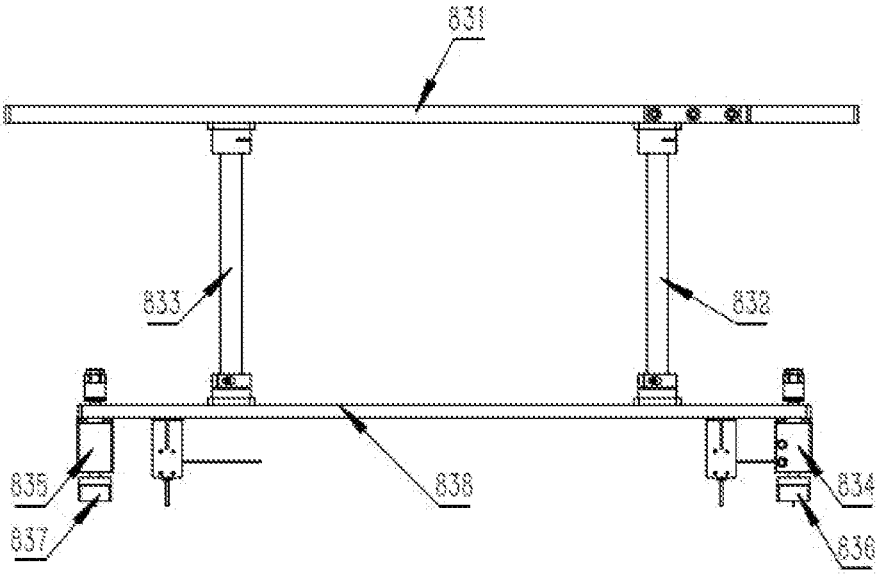
FIG. 55 shows a front view of a body cut tailoring mechanism according to one or more embodiments.
Figure 56:
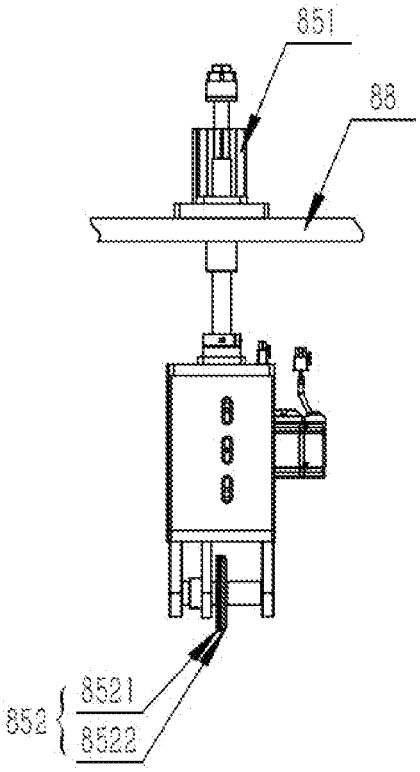
FIG. 56 shows a front view of a roll welding tailoring mechanism according to one or more embodiments.
Figure 57:
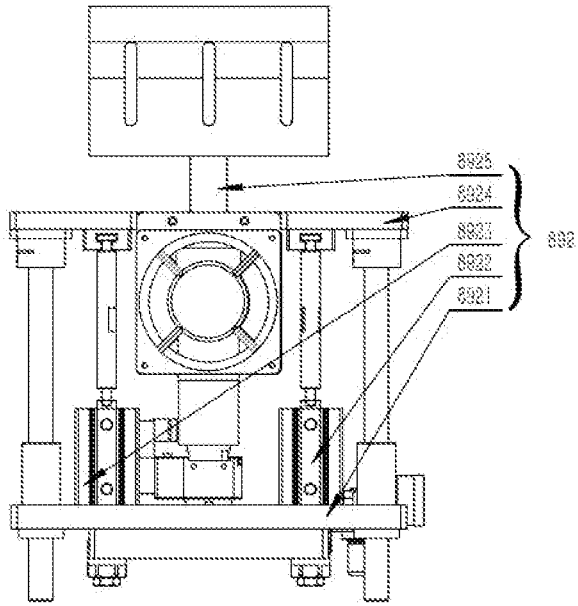
FIG. 57 shows a front view of a lower side welding die according to one or more embodiments.

After the sleeves are welded, the body is welded. That is, after the supplementary sleeve welding device seals the left sleeve and the right sleeve onto the combined body cloth, the body welding device welds combined body cloth together into a single piece and trims redundant cloth from the single piece FIG. 53 shows a structural schematic diagram of the body welding device according to one or more embodiments. FIG. 54 shows a side view of the body welding device according to one or more embodiments. FIG. 55 shows a front view of a body cut tailoring mechanism according to one or more embodiments. FIG. 56 shows a front view of a roll welding tailoring mechanism according to one or more embodiments. FIG. 57 shows a front view of a lower side welding die according to one or more embodiments.

As shown in the figures, according to one or more embodiments, the body welding device 8 includes a body locating frame 80, a right side sleeve delivery mechanism 81, a left side sleeve delivery mechanism 82, a right side body cut tailoring mechanism 83, a left side body cut tailoring mechanism 84, a right side roll welding tailoring mechanism 85, a left side roll welding tailoring mechanism 86, a body cut tailoring mechanism fixing plate 87, a roll welding tailoring mechanism fixing plate 88 and a lower welding mechanism 89. The right side body cut tailoring mechanism 83 includes a tailoring mechanism upper fixing plate 831, a tailoring mechanism right connecting rod 832, a tailoring mechanism left connecting rod 833, a tailoring mechanism right side cylinder 834, a tailoring mechanism left side cylinder 835, a tailoring mechanism left side cutter 836, a tailoring mechanism right side cutter 837 and a tailoring mechanism lower fixing plate 838. The right side roll welding tailoring mechanism 85 includes a roll welding tailoring mechanism cylinder 851 and a roll welding tailoring die 852. The roll welding tailoring die 852 includes a roll welding die head 8521 and a roll cutter 8522. The lower welding mechanism 89 includes a right side body lower part welding mechanism 891 and a left side body lower part welding mechanism 892. The structure of the right side body lower part welding mechanism 891 is the same as that of the left side body lower part welding mechanism 892, and only the left side body lower part welding mechanism 892 is described. As shown in the figures, the left side body lower part welding mechanism 892 includes a lower side welding die cylinder fixing plate 8921, a lower side welding die right cylinder 8922, a lower side welding die left cylinder 8923, a lower side welding die head fixing plate 8924 and a lower side welding die head 8925.

The top of the rear rack 13 is connected to the bottoms of the body cut tailoring mechanism fixing plate 87 and the roll welding tailoring mechanism fixing plate 88, the body locating frame 80 has a function of supporting the clothing, the clothing falls down or the cloth is crinkled without support, the body locating frame 80 is connected to the bottom of the rear rack 13, the right side sleeve delivery mechanism 81 and the left side sleeve delivery mechanism 82 are arranged on the left side and the right side of the rear rack 13, the body locating frame 80 is arranged at the middle position of the bottom of the rear rack 13, the right side body lower part welding mechanism 891 and the left side body lower part welding mechanism 892 are symmetrically arranged at the bottom of the rear rack 13, the right side roll welding tailoring mechanism 85 and the left side roll welding tailoring mechanism 86 are symmetrically arranged on the roll welding tailoring mechanism fixing plate 88, one side of the bottom of the tailoring mechanism upper fixing plate 831 is connected to the top of the body cut tailoring mechanism fixing plate 87, and the other side of the bottom of the tailoring mechanism upper fixing plate 831 is connected to the top of the roll welding tailoring mechanism fixing plate 88.

The tailoring mechanism upper fixing plate 831 is connected to the tailoring mechanism lower fixing plate 838 by the tailoring mechanism right connecting rod 832 and the tailoring mechanism left connecting rod 833, the tailoring mechanism right side cylinder 834 and the tailoring mechanism left side cylinder 835 are symmetrically arranged on the two sides of the tailoring mechanism lower fixing plate 838, and the tops of the tailoring mechanism left side cutter 836 and the tailoring mechanism right side cutter 837 are respectively connected to the tailoring mechanism right side cylinder 834 and the tailoring mechanism left side cylinder 835.

The roll welding tailoring mechanism cylinder 851 is arranged at the top of the roll welding tailoring mechanism fixing plate 88, and the top of the roll welding tailoring die 852 is connected to the bottom of the roll welding tailoring mechanism cylinder 851.

The lower side welding die cylinder fixing plate 8921 is arranged at the bottom of the rear rack 13, the lower side welding die right cylinder 8922 and the lower side welding die left cylinder 8923 are symmetrically arranged on the two sides of the lower side welding die cylinder fixing plate 8921, the tops of the lower side welding die right cylinder 8922 and the lower side welding die left cylinder 8923 are connected to the bottom of the lower side welding die head fixing plate 8924, and the lower side welding die head 8925 is fixedly connected to the middle position of the lower side welding die head fixing plate 8924.

Along the direction of forward movement of the cloth, the body cut tailoring mechanisms (including the right side body cut tailoring mechanism 83 and the left side body cut tailoring mechanism 84) are arranged in front of the roll welding tailoring mechanisms (the right side roll welding tailoring mechanism 85 and the left side roll welding tailoring mechanism 86). Namely, the cloth passes the body cut tailoring mechanisms firstly. Four cuts (two cuts are located on the left side, and the other two cuts are located on the right side.) are cut firstly, and then the whole body is welded and tailored by the roll welding tailoring mechanisms along with the forward movement of the cloth.

After the right rear body cloth 1101 of the clothing, the left rear body cloth 1301 of the clothing and the front body cloth 1401 of the clothing are combined, one armpit of the body cloth is moved from the body cloth to the position which is below the left side body cut tailoring mechanism 84 by the driving device, the body cut tailoring mechanisms are used for pushing the cutters 836 and 837 on the two sides to move downwards by the cylinders, and the cuts are cut on the side edges of the armpits and the bottom of the body by virtue of own tension of the cloth.

At the same time, the right side roll welding tailoring mechanism 85 and the left side roll welding tailoring mechanism 86 (the dies have the functions of welding and ruff tailoring simultaneously.) are used for pushing the roll welding die head 8521 and the roll cutter 8522 to move downwards by the cylinder (such as the cylinder 851) to tightly cling to the top of the lower side welding mechanism to start to carry out welding and cut off ruffs, and namely, at the positions of the cuts, the front body cloth is welded with the left rear body cloth, and the front body cloth is welded with the right rear body cloth (accurately, from the armpits to the bottom of the body). At the moment, the cloth moves forwards continuously, redundant ruffs are tailored down when the cloth moves to the bottom of the body, and the welding and the ruff cutting are carried out simultaneously in the step.

In the above processes, the lower part welding mechanism 89 is fixed, the roll welding tailoring mechanisms have driving sources to enable roll welding dies to do rotational movement to tightly cling to the top of the lower side welding mechanism, and welding and ruff tailoring are carried out when the cloth passes.

Figure 58:
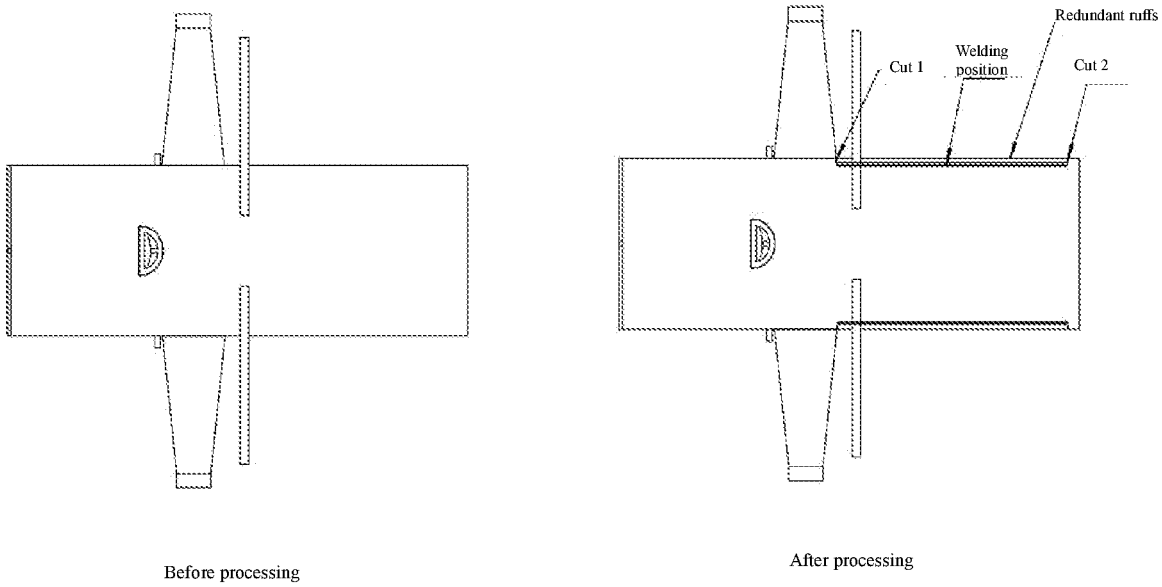
FIG. 58 shows schematic diagrams of cloth before and after body welding.

FIG. 58 shows schematic diagrams of the cloth before and after body welding.

Shoulders are welded after the single piece of body is welded.

Figure 59:
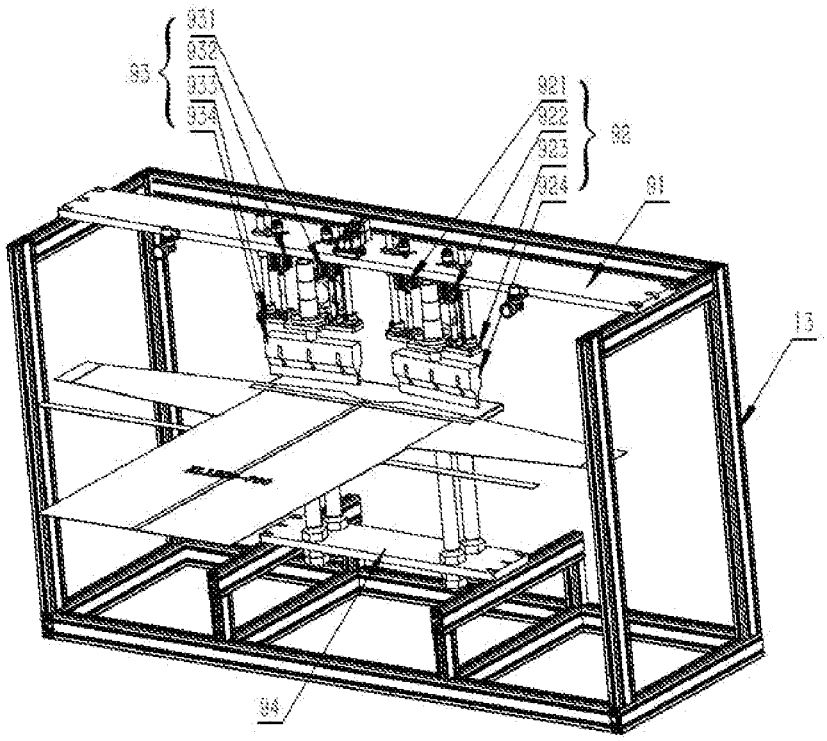
FIG. 59 shows a structural schematic diagram of a shoulder welding device according to one or more embodiments.

FIG. 59 shows a structural schematic diagram of the shoulder welding device according to one or more embodiments. As shown in FIG. 59, the shoulder welding device according to one or more embodiments includes a shoulder welding die fixing plate 91, a right side shoulder welding die 92, a left side shoulder welding die 93 and a body locating frame 94.

The right side shoulder welding die 92 includes a right shoulder welding die left side cylinder 921, a right shoulder welding die right side cylinder 922, a right shoulder welding die head fixing plate 923 and a right shoulder welding die head 924. The left side shoulder welding die 93 includes a left shoulder welding die right side cylinder 931, a left shoulder welding die left side cylinder 932, a left shoulder welding die head fixing plate 933 and a left shoulder welding die head 934.

The top of the rear rack 13 is connected to the bottom of the shoulder welding die fixing plate 91, the right side shoulder welding die 92 and the left side shoulder welding die 93 are symmetrically arranged on the two sides of the shoulder welding die fixing plate 91, and the body locating frame 94 is arranged at the bottom of the rear rack 13 and has a function of supporting the body and a welding base plate. The shoulder welding die cylinders are respectively arranged on the shoulder welding die fixing plate 91, the bottoms of the shoulder welding die cylinders are connected to the tops of the welding die head fixing plates, and the shoulder welding die heads are arranged at the middle position of the shoulder welding die head fixing plates.

Figure 60:
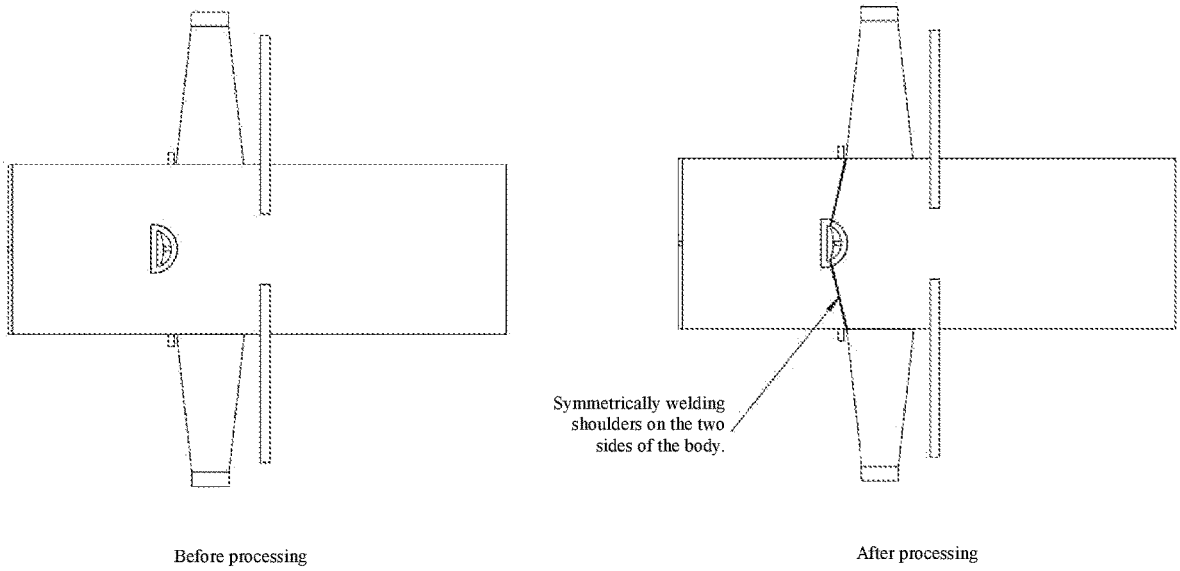
FIG. 60 shows schematic diagrams of cloth before and after shoulder welding.

When the body cloth moves to the welding positions of the shoulders, the shoulder welding die cylinders move downwards to push the welding die head fixing plates to move downwards, then the shoulder welding die heads are driven to move downwards to a top plate of the body locating frame 94 to carry out ultrasonic fusion welding on the shoulders, so that the welding of the front body cloth and the rear piece cloth is completed, and the shoulders are directly welded to the positions of the sleeves. FIG. 60 shows schematic diagrams of the cloth before and after shoulder welding.

Body separation is carried out after shoulder welding is completed. Body separation may be needed because in reality, cloth fabrics for two or more bodies may be fed and processed at once, resulting in two or more apparel items manufactured in one round of assembly. A separation process is thus needed in such situations.

Figure 61:
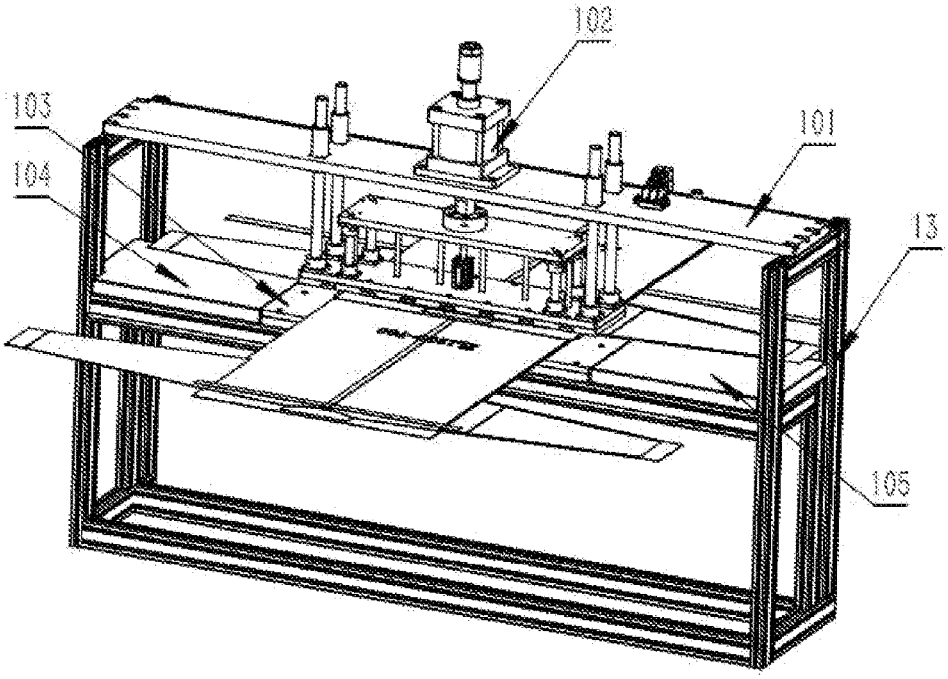
FIG. 61 shows a structural schematic diagram of work of a cloth separator according to one or more embodiments.
Figure 62:
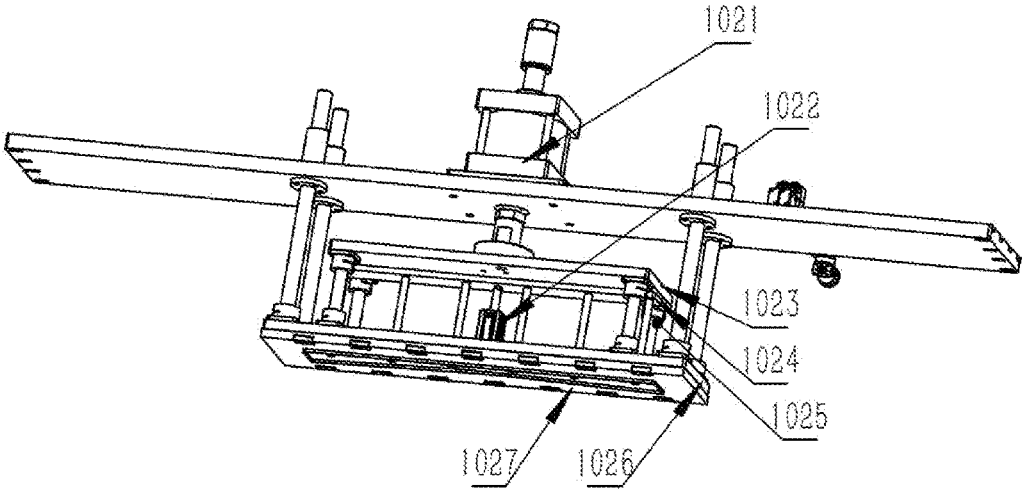
FIG. 62 shows a structural schematic diagram of a body separation die according to one or more embodiments.

FIG. 61 shows a structural schematic diagram of the cloth separator according to one or more embodiments. FIG. 62 shows a structural schematic diagram of a body separation die according to one or more embodiments.

As shown in FIG. 61 and FIG. 62, the cloth separator according to one or more embodiments includes a body separation die fixing plate 101, the body separation die 102, a cutting base plate 103, a left side sleeve support plate 104 and a right side sleeve support plate 105. The body separation die 102 includes a cutting die cylinder 1021, a blanking die cylinder 1022, a cutting die cylinder push plate 1023, a blanking push rod connecting plate 1024, a blanking push rod 1025, a cutting die connecting plate 1026 and a cutting die 1027.

The top of the rear rack 13 is connected to the bottom of the body separation die 102, the cutting base plate 103 is arranged at the middle position of the rear rack 13, and the left side sleeve support plate 104 and the right side sleeve support plate 105 are symmetrically arranged at the middle position of the rear rack 13.

The cutting die cylinder 1021 is arranged at the middle position of the body separation die fixing plate 101, the bottom of the cutting die cylinder 1021 is connected to the top of the cutting die cylinder push plate 1023, the blanking push rod 1025 is arranged at the bottom of the blanking push rod connecting plate 1024, the middle position of the bottom of the blanking push rod connecting plate 1024 is connected to the top of the blanking die cylinder 1022, the cutting die connecting plate 1026 is connected to the cutting die cylinder push plate 1023 by a connecting rod, and the top of the cutting die 1027 is connected to the cutting die connecting plate 1026. The blanking die cylinder 1022 is arranged on the cutting die connecting plate 1026.

Figure 63:
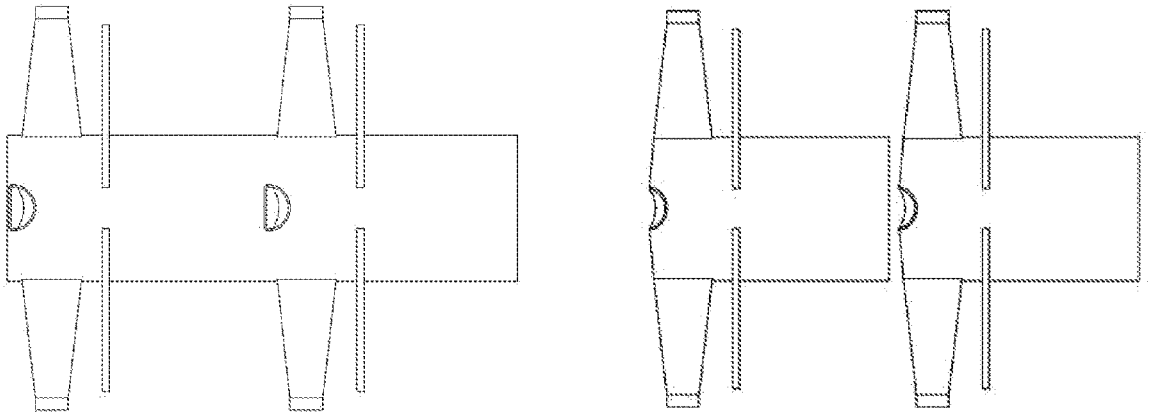
FIG. 63 shows a schematic diagram of cloth before and after body separation.

The device shows in FIGS. 61 and 62 realizes a function of separating two pieces of ready-made clothing; when the two pieces of ready-made clothing move to the position, the cutting die cylinder 1021 works to drive the cutting die cylinder push plate 1023 connected to the cutting die cylinder 1021 to move downwards, and then the cutting die connecting plate 1026 connected to the cutting die cylinder push plate 1023 by the connecting rod moves downwards to drive the cutting die 1027 connected to the cutting die connecting plate 1026 to move downwards to cut the cloth. In one or more embodiment, a pressing device may be set to press and tighten the cloth before separating. The cutter to cut the cloth may be a serrated blade or a flat blade. The blanking die cylinder 1022 works to drive the blanking push rod connecting plate 1024 to move downwards, and then the blanking push rod 1025 connected to the blanking push rod connecting plate 1024 is driven to move downwards to push waste cloth tailored down into a blanking barrel. FIG. 63 shows a schematic diagram of the cloth before and after body separation. Blanking refers to that the waste cloth is removed, and the part between the two cutters is the waste cloth.

According to one implantation manner of the present invention, the cutters for cutting the left rear collar and the right rear collar are combined with the cutter in the step, so that the cutters not only have a function of separating the two pieces of clothing, but also have a function of cutting the left rear collar and the right rear collar.

Then, the ready-made clothing after body separation is folded.

Figure 64:
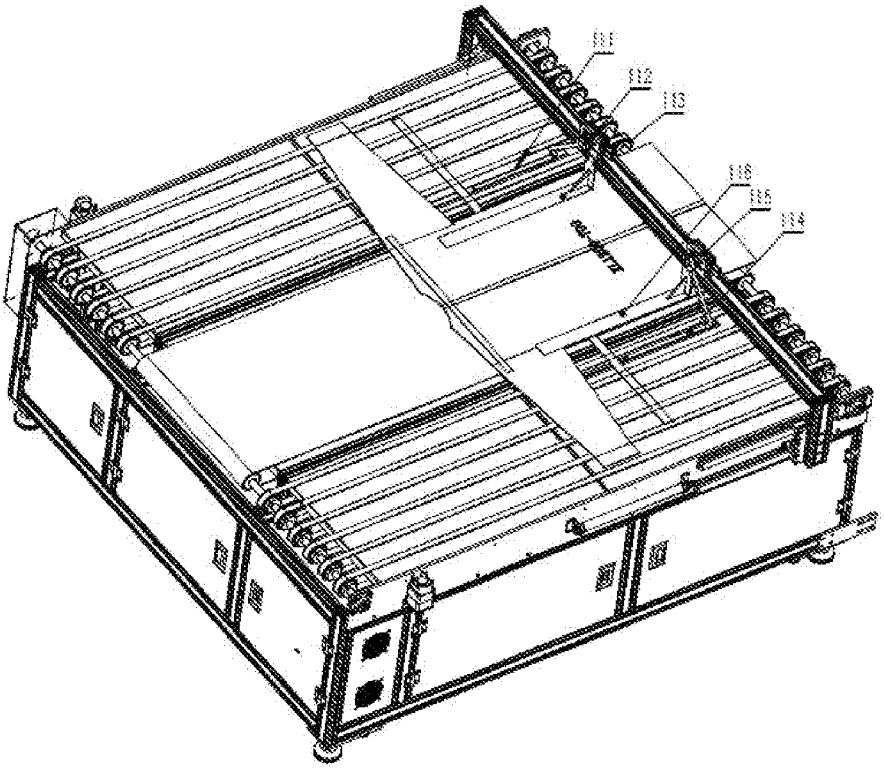
FIG. 64 shows a structural schematic diagram of a folding device according to one or more embodiments.

FIG. 64 shows a structural schematic diagram of the folding device according to one or more embodiments. As shown in FIG. 64, according to one or more embodiments, the folding device includes a left side sleeve folding rod 111, a left side body pressing plate driving mechanism 112, a left side body pressing plate 113, a right side sleeve folding rod 114, a right side body pressing plate driving mechanism 115 and a right side body pressing plate 116.

The left side sleeve folding rod 111 and the right side sleeve folding rod 114 are connected to the two sides of a rack, the left side body pressing plate driving mechanism 112 and the right side body pressing plate driving mechanism 115 are connected to the two sides of the rack, and the left side body pressing plate 113 and the right side body pressing plate 116 are respectively connected to the left side body pressing plate driving mechanism 112 and the right side body pressing plate driving mechanism 115.

When the clothing passes the folding device (a plurality of rows of belts are arranged on the folding device and are controlled to rotate by a motor, thereby ensuring that the clothing is conveyed on the folding device), the left side body pressing plate 113 and the right side body pressing plate 116 are used for pressing the body position and have a fixing function, then the left side sleeve folding rod 111 and the right side sleeve folding rod 114 rotate to hook the sleeves and the belts and folding the sleeves and the belts at the position which is above the body. FIG. 65 shows the ready-made clothing before and after being folded. In one or more embodiments, a flattening device may be set to press and flatten right after each folding step.

In reality, when apparel components are moving along the assembly direction at various stages, it is important to make sure the clothes do not drift from the designated moving direction; otherwise the seaming and welding processes may be of error. In some embodiments, the system uses a processor and a sensor that monitors the transmission of the clothes on transmission belts and/or via guide rollers. In response to the sensor detecting a cloth is drifting from a designated moving direction, the processor controls the transmission belt to move the cloth back to the designated moving direction. The processor also controls the speed of the guide rollers to be the same to keep various stages of manufacturing in sync. Moreover, the guide rollers in the system are all in parallel to each other and perpendicular to the assembly direction.

In addition, because the sleeves are made in parallel to the body assembly line, the sleeve makers each have a sleeve moving platform that moves the sleeves to the sleeve welding device. The sleeves may be very light and thin, so it is important to keep the sleeves from being displaced. To this end, the sleeve moving platform includes a plurality of vacuum suction cups that suck the sleeves. The sleeve moving platform also includes a pressure sensor that detects whether the sleeves are fastened to the vacuum suction cups. When the pressure sensor detects that the sleeves are fastened, the mechanical arms of the left and right sleeve feeders pick up the sleeves and start the welding process.

The above descriptions of the specific embodiments of the present invention are only exemplary for the purpose that those skilled in the art can understand and realize the embodiments of the present invention, and the protection scope of the invention restricted by the claims is not limited thereto.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A system for manufacturing apparel, wherein the apparel comprises a two-layered collar, a collar lace, a belt, a plurality of sleeves, a front body cloth, a left rear body cloth, and a right rear body cloth, the system comprising:

a cloth feeder; a collar welding device; a collar lace welding device; a belt welding device; a collar cutting device; a sleeve welding device; a supplementary sleeve welding device; a body welding device; a shoulder welding device; and a pair of sleeve makers that make the sleeves, wherein the cloth feeder, the collar welding device, the collar lace welding device, the belt welding device, the collar cutting device, the sleeve welding device, the supplementary sleeve welding device, the body welding device, the shoulder welding device are disposed in order along a direction from a first end of the system to the second end of the system, wherein the pair of sleeve makers are disposed adjacent to the sleeve welding device, and wherein the pair of sleeve makers are symmetrically disposed about the direction.

2. The system according to claim 1, further comprising a first rack and a second rack, wherein the cloth feeder, the collar welding device, the collar lace welding device, the belt welding device, and the collar cutting device are disposed on the first rack, and wherein the sleeve welding device, the supplementary sleeve welding device, the body welding device, the shoulder welding device are disposed on the second rack.

3. The system according to claim 2, wherein the cloth feeder comprises:

a first plate that feeds the front body cloth to the collar welding device;

a second plate that feeds the left rear body cloth; and a third plate that feeds the right rear body cloth, wherein the first plate, the second plate, and the third plate are disposed one above another and are movable along the direction, and wherein the front body cloth, the left rear body cloth, and the right rear body cloth are stretched along the direction.

4. The system according to claim 3, wherein the cloth feeder comprises a plurality of controllers that control stretching forces on the front body cloth, the left rear body cloth, and the right rear body cloth.

5. The system according to claim 3, wherein the collar welding device comprises: a cutting board with a hollow center; a cutting knife that moves through the hollow center; a movable collar welding die; and a collar welding head, wherein the cutting knife cuts the collar from a collar fabric, wherein the collar welding die sends the collar to the collar welding head, and wherein the collar welding head welds the collar onto the front body cloth by ultrasonic welding.

6. The system according to claim 5, wherein, after the collar is welded onto the front body cloth, the front body cloth is sent to the belt welding device, wherein the belt welding device comprises: a belt moving platform; a movable belt welding die; a belt welding head; and a belt cutter, and wherein the belt moving platform sends a belt fabric to a belt position adjacent to the front body cloth, wherein the movable belt welding die drives the belt fabric to be in contact with the front body cloth, wherein the belt welding head welds the belt fabric onto the front body cloth by ultrasonic welding, and wherein the belt cutter cuts the belt fabric to leave the belt on the front body cloth.

7. The system according to claim 6, wherein the belt moving platform comprises a mechanical claw.

8. The system according to claim 6, wherein the belt comprises a left belt piece and a right belt piece.

9. The system according to claim 6, wherein the collar lace welding device comprises a left half and a right half that are symmetrically disposed about the direction.

10. The system according to claim 9, wherein the collar lace comprises a left collar lace piece and a right collar lace piece, wherein the left half of the collar lace welding device welds the left collar lace piece onto the left rear body cloth, and wherein the right half of the collar lace welding device welds the right collar lace piece onto the right rear body cloth.

11. The system according to claim 10, wherein, after the left collar lace piece is welded onto the left rear body cloth, after the right collar lace piece is welded onto the right rear body cloth, and after the belt is welded onto the front body cloth, the left rear body cloth, the right rear body cloth, and the front body cloth are sent to the collar cutting device, wherein the collar cutting device comprises a front collar cutter, a left rear collar cutter, and a right rear collar cutter, wherein each of the front collar cutter, the left rear collar cutter, and the right rear collar cutter comprises a collar cutting knife that cuts a shape.

12. The system according to claim 11, wherein the collar cutting knife of the left rear collar cutter and the collar cutting knife of the right rear collar cutter are configured to cut the shapes of identical dimensions, and wherein the collar cutting knife of the front collar cutter is configured to cut the shape of a greater dimension that the dimensions of the shapes cut by the collar cutting knives of the left rear collar cutter and the right rear collar cutter.

13. The system according to claim 1, wherein the sleeve welding device comprises a left sleeve feeder and a right sleeve feeder that receive the sleeves from the pair of sleeve makers.

14. The system according to claim 13, wherein each of the left sleeve feeder and the right sleeve feeder comprises a mechanical arm with a plurality of suction cups that suck the sleeves such that a shoulder side of each of the sleeves is open, wherein the sleeve welding device combines the front body cloth, the left rear body cloth, and the right rear body cloth to form a combined body cloth with a left sleeve opening and a right sleeve opening, wherein the mechanical arm of the left sleeve feeder sends the shoulder side of a left sleeve to the left sleeve opening and the mechanical arm of the right sleeve feeder sends the shoulder side of a right sleeve to the right sleeve opening, and wherein the sleeve welding device welds the left sleeve and the right sleeve onto the combined body cloth.

15. The system according to claim 14, wherein the mechanical arm of each of the left sleeve feeder and the right sleeve feeder comprises a movable belt that moves up and down to support the left sleeve and the right sleeve such that the left sleeve and the right sleeve are level in a horizontal plane of the combined body cloth.

16. The system according to claim 14, wherein, after the left sleeve and the right sleeve are welded onto the combined body cloth, the supplementary sleeve welding device seals the left sleeve and the right sleeve onto the combined body cloth.

17. The system according to claim 16, wherein, after the supplementary sleeve welding device seals the left sleeve and the right sleeve onto the combined body cloth, the body welding device welds combined body cloth together into a single piece and trims redundant cloth from the single piece.

18. The system according to claim 17, wherein the shoulder welding device seals a left shoulder of the single piece between the front body cloth and the left rear body cloth and seals a right shoulder of the single piece between the front body cloth and the right rear body cloth.

19. The system according to claim 18, wherein, after the right shoulder and the left shoulder are sealed, cloth separator cuts the single piece perpendicular to the direction to separate the single piece into two pieces of apparel.

20. The system according to claim 19, further comprising a cloth folder wherein the cloth folder comprises: a transmission belt driven by a motor; a pressing plate that presses the two pieces of apparel on the transmission belt; and a plurality of foldable rods that fold the sleeves and the belts on top of the two pieces of apparel.

21. The system according to claim 1, further comprising a transmission belt and a plurality of guide rollers, wherein clothes for making the apparel are transmitted on the transmission belt and guided by the guide rollers.

22. The system according to claim 21, further comprising a processor and a sensor that monitors the transmission of the clothes, wherein the guide rollers are parallel to each other, wherein the processor controls a speed of each of the guide rollers, wherein, in response to the sensor detecting a cloth is drifting from a designated moving direction, the processor controls the transmission belt to move the cloth back to the designated moving direction.

23. The system according to claim 1, wherein each of the sleeve makers comprises a sleeve moving platform that moves the sleeves to the sleeve welding device, wherein the sleeve moving platform comprises a plurality of vacuum suction cups that suck the sleeves, and wherein the sleeve moving platform further comprises a pressure sensor that detects whether the sleeves are fastened to the vacuum suction cups.

* * * * *